US010738258B2

(12) United States Patent
Burns, III et al.

(10) Patent No.: US 10,738,258 B2
(45) Date of Patent: Aug. 11, 2020

(54) METHOD FOR IMPROVING ENGINE FUEL EFFICIENCY AND ENERGY EFFICIENCY

(71) Applicant: ExxonMobil Research and Engineering Company, Annandale, NJ (US)

(72) Inventors: Raymond G. Burns, III, Aston, PA (US); Smruti A. Dance, Robbinsville, NJ (US); Douglas E. Deckman, Mullica Hill, NJ (US); Mark P. Hagemeister, Mullica Hill, NJ (US)

(73) Assignee: EXXONMOBIL RESEARCH AND ENGINEERING COMPANY, Annandale, NJ (US)

( * ) Notice: Subject to any disclaimer, the term of this patent is extended or adjusted under 35 U.S.C. 154(b) by 0 days.

(21) Appl. No.: 15/928,996

(22) Filed: Mar. 22, 2018

(65) Prior Publication Data

US 2018/0273870 A1 Sep. 27, 2018

Related U.S. Application Data

(60) Provisional application No. 62/475,980, filed on Mar. 24, 2017.

(51) Int. Cl.
*C10M 105/36* (2006.01)
*C10M 101/02* (2006.01)
(Continued)

(52) U.S. Cl.
CPC ..... *C10M 105/36* (2013.01); *C10M 101/02* (2013.01); *C10M 105/04* (2013.01);
(Continued)

(58) Field of Classification Search
CPC .... C10M 2203/1006; C10M 2207/401; C10M 2203/022; C10M 2205/0285;
(Continued)

(56) References Cited

U.S. PATENT DOCUMENTS 1,815,022 A 7/1931 Davis
2,015,748 A 10/1935 Frolich
(Continued)

FOREIGN PATENT DOCUMENTS

CA 1094044 A 1/1981
EP 0089709 A1 9/1983
(Continued)

OTHER PUBLICATIONS

Henderson, "Gas to Liquids", Synthetics, Mineral Oils, and Bio-Based Lubricants: Chemistry and Technology, Second Edition, Chapter 19, 2013, pp. 333-346.
(Continued)

*Primary Examiner* — Vishal V Vasisth
(74) *Attorney, Agent, or Firm* — Anthony G. Boone; Roben A. Migliorini

(57) ABSTRACT

A method for improving fuel efficiency and energy efficiency, while maintaining or improving deposit control and cleanliness performance, in an engine lubricated with a lubricating oil by using as the lubricating oil a formulated oil. The formulated oil includes a base oil mixture. The base oil mixture includes a lubricating oil base stock as a major component, and at least one cobase stock, as a minor component. The at least one cobase stock is present in an amount sufficient to reduce kinematic viscosity ($Kv_{100}$) of the base oil mixture as determined by ASTM D445, while maintaining or controlling cold cranking simulator viscosity (CCSV) of the lubricating oil as determined by ASTM D5293-15, such that the lubricating oil meets both kinematic viscosity ($Kv_{100}$) and cold cranking simulator viscosity (CCSV) requirements for a SAE engine oil grade as determined by SAE J300 viscosity grade classification system. A lubricating oil having a composition including a lubricating
(Continued)

oil base stock as a major component, and at least one cobase stock, as a minor component.

27 Claims, 10 Drawing Sheets

(51) Int. Cl.

| | |
|---|---|
| ***C10M 105/34*** | (2006.01) |
| ***C10M 105/04*** | (2006.01) |
| ***C10M 107/10*** | (2006.01) |
| ***C10M 169/04*** | (2006.01) |
| ***C10M 171/02*** | (2006.01) |
| ***C10M 111/02*** | (2006.01) |

(52) U.S. Cl.
CPC ..... *C10M 105/34* (2013.01); *C10M 107/10* (2013.01); *C10M 111/02* (2013.01); *C10M 169/04* (2013.01); *C10M 171/02* (2013.01); *C10M 2203/02* (2013.01); *C10M 2203/022* (2013.01); *C10M 2203/0206* (2013.01); *C10M 2203/1006* (2013.01); *C10M 2203/1025* (2013.01); *C10M 2205/0206* (2013.01); *C10M 2205/028* (2013.01); *C10M 2205/0285* (2013.01); *C10M 2205/173* (2013.01); *C10M 2207/281* (2013.01); *C10M 2207/2815* (2013.01); *C10M 2207/40* (2013.01); *C10M 2207/401* (2013.01); *C10N 2210/02* (2013.01); *C10N 2210/03* (2013.01); *C10N 2210/06* (2013.01); *C10N 2230/02* (2013.01); *C10N 2230/04* (2013.01); *C10N 2230/08* (2013.01); *C10N 2230/52* (2013.01); *C10N 2230/54* (2013.01); *C10N 2230/68* (2013.01); *C10N 2230/74* (2013.01); *C10N 2240/10* (2013.01)

(58) Field of Classification Search
CPC ..... C10M 2207/2815; C10N 2230/02; C10N 2240/10; C10N 2230/54
See application file for complete search history.

(56) References Cited

U.S. PATENT DOCUMENTS

| | | | |
|---|---|---|---|
| 2,191,498 | A | 2/1940 | Reiff |
| 2,387,501 | A | 10/1945 | Dietrich |
| 2,655,479 | A | 10/1953 | Munday et al. |
| 2,666,746 | A | 1/1954 | Munday et al. |
| 2,721,877 | A | 10/1955 | Popkin et al. |
| 2,721,878 | A | 10/1955 | Popkin |
| 2,817,693 | A | 12/1957 | Jacob et al. |
| 3,036,003 | A | 5/1962 | Arthur |
| 3,087,936 | A | 4/1963 | Le Suer |
| 3,149,178 | A | 9/1964 | Hamilton et al. |
| 3,172,892 | A | 3/1965 | Le Suer et al. |
| 3,200,107 | A | 8/1965 | Le Suer |
| 3,219,666 | A | 11/1965 | Norman et al. |
| 3,250,715 | A | 5/1966 | Wyman |
| 3,254,025 | A | 5/1966 | Le Suer |
| 3,272,746 | A | 9/1966 | Le Suer et al. |
| 3,275,554 | A | 9/1966 | Hendrik |
| 3,316,177 | A | 4/1967 | Dorer |
| 3,322,670 | A | 5/1967 | Burt et al. |
| 3,329,658 | A | 7/1967 | Fields |
| 3,341,542 | A | 9/1967 | Le Suer et al. |
| 3,382,291 | A | 5/1968 | Brennan |
| 3,413,347 | A | 11/1968 | Worrel |
| 3,438,757 | A | 4/1969 | Honnen et al. |
| 3,444,170 | A | 5/1969 | Norman et al. |
| 3,449,250 | A | 6/1969 | Fields |
| 3,454,555 | A | 7/1969 | Van Der Voort et al. |
| 3,454,607 | A | 7/1969 | Le Suer et al. |
| 3,519,565 | A | 7/1970 | Coleman |
| 3,541,012 | A | 11/1970 | Stuebe |
| 3,565,804 | A | 2/1971 | Honnen et al. |
| 3,595,791 | A | 7/1971 | Cohen |
| 3,630,904 | A | 12/1971 | Musser et al. |
| 3,632,511 | A | 1/1972 | Liao |
| 3,652,616 | A | 3/1972 | Watson et al. |
| 3,666,730 | A | 5/1972 | Coleman |
| 3,666,827 | A | 5/1972 | Carlson et al. |
| 3,687,849 | A | 8/1972 | Abbott |
| 3,697,574 | A | 10/1972 | Piasek et al. |
| 3,702,300 | A | 11/1972 | Coleman |
| 3,703,536 | A | 11/1972 | Piasek et al. |
| 3,704,308 | A | 11/1972 | Piasek et al. |
| 3,725,277 | A | 4/1973 | Worrel |
| 3,725,480 | A | 4/1973 | Traise et al. |
| 3,726,882 | A | 4/1973 | Traise et al. |
| 3,742,082 | A | 6/1973 | Brennan |
| 3,751,365 | A | 8/1973 | Piasek et al. |
| 3,755,433 | A | 8/1973 | Hellmuth |
| 3,756,953 | A | 9/1973 | Piasek et al. |
| 3,769,363 | A | 10/1973 | Brennan |
| 3,780,128 | A | 12/1973 | Shubkin |
| 3,787,374 | A | 1/1974 | Adams |
| 3,798,165 | A | 3/1974 | Piasek et al. |
| 3,803,039 | A | 4/1974 | Piasek et al. |
| 3,822,209 | A | 7/1974 | Knapp et al. |
| 3,837,023 | A | 8/1974 | Ladeur et al. |
| 3,876,720 | A | 4/1975 | Heilman et al. |
| 3,948,800 | A | 4/1976 | Meinhardt |
| 4,100,082 | A | 7/1978 | Clason et al. |
| 4,149,178 | A | 4/1979 | Estes |
| 4,218,330 | A | 8/1980 | Shubkin |
| 4,234,435 | A | 11/1980 | Meinhardt et al. |
| 4,239,930 | A | 12/1980 | Allphin et al. |
| 4,367,352 | A | 1/1983 | Watts et al. |
| 4,413,156 | A | 11/1983 | Watts et al. |
| 4,426,305 | A | 1/1984 | Malec |
| 4,434,408 | A | 2/1984 | Baba et al. |
| 4,454,059 | A | 6/1984 | Pindar et al. |
| 4,594,172 | A | 6/1986 | Sie |
| 4,658,078 | A | 4/1987 | Slaugh et al. |
| 4,767,551 | A | 8/1988 | Hunt et al. |
| 4,798,684 | A | 1/1989 | Salomon |
| 4,827,064 | A | 5/1989 | Wu |
| 4,827,073 | A | 5/1989 | Wu |
| 4,897,178 | A | 1/1990 | Best et al. |
| 4,910,355 | A | 3/1990 | Shubkin et al. |
| 4,921,594 | A | 5/1990 | Miller |
| 4,943,672 | A | 7/1990 | Hamner et al. |
| 4,952,739 | A | 8/1990 | Chen |
| 4,956,122 | A | 9/1990 | Watts et al. |
| 4,975,177 | A | 12/1990 | Garwood et al. |
| 5,068,487 | A | 11/1991 | Theriot |
| 5,084,197 | A | 1/1992 | Galic et al. |
| 5,086,487 | A | 1/1992 | Katayama et al. |
| 5,264,642 | A | 11/1993 | Wu |
| 5,358,628 | A | 10/1994 | Apelian et al. |
| 5,366,648 | A | 11/1994 | Salomon et al. |
| 5,382,739 | A | 1/1995 | Atkins et al. |
| 5,430,105 | A | 7/1995 | Redpath et al. |
| 5,688,887 | A | 11/1997 | Bagheri et al. |
| 5,705,458 | A | 1/1998 | Roby et al. |
| 5,728,907 | A | 3/1998 | Squicciarini et al. |
| 6,034,039 | A | 3/2000 | Gomes et al. |
| 6,080,301 | A | 6/2000 | Berlowitz et al. |
| 6,090,989 | A | 7/2000 | Trewella et al. |
| 6,165,949 | A | 12/2000 | Berlowitz et al. |
| 6,992,049 | B2 | 1/2006 | Deckman et al. |
| 7,687,445 | B2 | 3/2010 | Rosenbaum et al. |
| 7,989,670 | B2 | 8/2011 | Wu et al. |
| 8,921,291 | B2 | 12/2014 | Wu et al. |
| 2003/0055184 | A1 | 3/2003 | Song et al. |
| 2003/0191032 | A1* | 10/2003 | Deckman ..... C10M 159/20 508/460 |
| 2004/0129603 | A1 | 7/2004 | Cody et al. |
| 2006/0105920 | A1 | 5/2006 | Dalman et al. |
| 2006/0172898 | A1 | 8/2006 | Roby et al. |
| 2006/0247138 | A1 | 11/2006 | Rosenbaum et al. |
| 2008/0020950 | A1 | 1/2008 | Gray et al. |

(56) References Cited

U.S. PATENT DOCUMENTS

| | | | | |
|---|---|---|---|---|
| 2009/0036725 | A1 | 2/2009 | Wu et al. | |
| 2013/0090277 | A1* | 4/2013 | Martin | C10M 169/04 508/459 |
| 2015/0344805 | A1* | 12/2015 | Dance | C10M 157/04 508/293 |
| 2016/0237375 | A1 | 8/2016 | Hogendoorn | |
| 2017/0183594 | A1 | 6/2017 | Courtiade et al. | |
| 2017/0226441 | A1 | 8/2017 | Courtiade et al. | |
| 2018/0112148 | A1 | 4/2018 | Bouvier et al. | |

FOREIGN PATENT DOCUMENTS

| | | | |
|---|---|---|---|
| EP | 464546 | A1 | 1/1992 |
| GB | 1350257 | A | 4/1974 |
| GB | 1390359 | A | 4/1975 |
| GB | 1440230 | A | 6/1976 |

OTHER PUBLICATIONS

Kajdas et al., "Antiwear properties and tribochemical reactions of esters of palmitic acid and aliphatic alcohols in the steel-on-steel friction systems", Tribologia, vol. 29, pp. 389-402, 1998.
Anastopoulos et al., "Lubrication Properties of Low-Sulfur Diesel Fuels in the Presence of Specific Types of Fatty Acid Derivatives", Energy & Fuels, vol. 15, pp. 106-112, 2001.
Onopchenko et al., "Tetraalkylsilanes via Hydrosilylation of 1-Alkenes", Journal of Chemical Eng. Data, vol. 33, pp. 64-66, 1988.
Singh et al., "Tribological Behavior of Some Hydrocarbon Compounds and Their Blends", Wear, vol. 139, pp. 425-437, 1990.
The International Search Report and Written Opinion of PCT/US2018/023922 dated Jul. 16, 2018.

* cited by examiner

Fig. 3

| | C28 Methyl Paraffin | C18 Dimer | Decyl Palmitate | Coconut Oil |
|---|---|---|---|---|
| KV100, cSt | 3.5 | 6.11 | 3.2 | 5.96 |
| KV40, cSt | 12.52 | 29.3 | 10.7 | 28.78 |
| HTHS, cP | 1.39 | 2.1 | | |
| CCS@-35°C, cP (calculated) | 2,500,000 | | 2,000,000 | |
| Viscosity Index | 174 | 163 | 183 | 159 |
| Volatility, % | 10.7 | 3.2 | | |

Fig. 5

| Group | Basestock | KV @ 40C, cSt | KV @ 100C, cSt | VI | CCS - 30, cP | CCS - 35, cP | D5800 Lost, % | D97 Pour Point, °C |
|---|---|---|---|---|---|---|---|---|
| II | Group II 4.5 | 22.2 | 4.5 | 115 | 3036 | 6546 | 13.8 | -14 |
| II | Group II 6 | 36.1 | 6.1 | 113 | 9038 | | 8.3 | -18 |
| III | Group III - A4 | 18.0 | 4.1 | 129 | 1100 | 1800 | 13.7 | -27 |
| III | Group III - A8 | 44.3 | 7.7 | 143 | 5246 | 9700 | 2.1 | -30 |
| III | Group III - B4 | 19.38 | 4.23 | 125 | 1476 | 2660 | 13.9 | -15 |
| III | Group III - B6 | 36.15 | 6.42 | 130 | 4878 | 9797 | 6.78 | -14.4 |
| III | Group IIIC - 4 | 17.17 | 4.08 | 143 | | 1528 | 13.2 | -19 |
| III | Group IIIC - 6 | 34.3 | 6.5 | 146 | 3640 | 6443 | 6.8 | -19 |
| IV | Group IV - 2 | 5.05 | 1.68 | 88 | | | 100 | <-60 |
| IV | Group IV - 4 | 18.5 | 4.1 | 126 | 953 | 1493 | 13.2 | -57 |
| IV | Group IV - 6 | 30.0 | 5.8 | 141 | 2125 | 3580 | 5.6 | -54 |
| V | Group V - A | 28.3 | 4.8 | 80 | 6128 | 11770 | 10.8 | -40.5 |
| V | Group V - B | 19.2 | 4.3 | 138 | 1273 | 2247 | 4.5 | -45 |

Fig. 6

| | | Comparative Example 1 | Comparative Example 2 | Comparative Example 3 | Comparative Example 4 | Comparative Example 5 | Comparative Example 6 | Inventive Example 1 | Inventive Example 2 | Inventive Example - calculated 3 |
|---|---|---|---|---|---|---|---|---|---|---|
| C28 Methylparaffin, % | | | | | | | | 7.5 | 8.2 | 9.8 |
| Group IV - 4, % | | | | 33.54 | 33.54 | | | | 25.14 | |
| Group III - A4, % | | 42 | 77.34 | | 44.2 | 17.4 | 36 | 65.84 | 40 | 66.54 |
| Group III - A8, % | | 35.42 | | 44.2 | | | | | | |
| Group II - 6, % | | | | | | 59.84 | 41.24 | | | |
| Group V - B, % | | 5 | 5 | 5 | 5 | 5 | 5 | 5 | 5 | 5 |
| VM, % | | 4.0 | 4.0 | 3.6 | 3.6 | 4.1 | 4.1 | 8.0 | 8.0 | 5.0 |
| Additive system 1, % | | 13.66 | 13.66 | 13.66 | 13.66 | 13.66 | 13.66 | 13.66 | 13.66 | 13.66 |
| Total | | 100.00 | 100.00 | 100.00 | 100.00 | 100.00 | 100.00 | 100.00 | 100.00 | 100.00 |
| Base Oil Viscosity, 100°C, cSt | D445 | 5.66 | 4.11 | 5.75 | 4.12 | 5.5 | 5.00 | 4.05 | 4.05 | 5.00 |
| SAE Viscosity Grade | | 5W-30 | 0W-30 | 5W-30 | 0W-30 | 10W-30 | 5W-30 | 5W-30 | 5W-30 | 10W-30 |
| Calcium, % | D5185 | 0.22 | 0.22 | 0.22 | 0.22 | 0.22 | 0.22 | 0.22 | 0.22 | 0.22 |
| Magnesium, % | D5185 | 0.00 | 0.00 | 0.00 | 0.00 | 0.00 | 0.00 | 0.00 | 0.00 | 0.00 |
| Boron, % | D5185 | 0.010 | 0.010 | 0.010 | 0.010 | 0.010 | 0.010 | 0.010 | 0.010 | 0.010 |
| Phosphorus, % | D5185 | 0.08 | 0.08 | 0.08 | 0.08 | 0.08 | 0.08 | 0.08 | 0.08 | 0.08 |
| Zinc, % | D5185 | 0.08 | 0.08 | 0.08 | 0.08 | 0.08 | 0.08 | 0.08 | 0.08 | 0.08 |
| Molybdenum, % | D5185 | 0.011 | 0.011 | 0.011 | 0.011 | 0.011 | 0.011 | 0.011 | 0.011 | 0.011 |
| Sulfated Ash, % | D874 | 0.92 | 0.92 | 0.92 | 0.92 | 0.92 | 0.92 | 0.92 | 0.92 | 0.92 |
| TBN, mgKOH/g | D2896 | 8.63 | 8.63 | 8.63 | 8.63 | 8.63 | 8.63 | 8.63 | 8.63 | 8.63 |
| TBN, mgKOH/g | D4739 | 6.79 | 6.79 | 6.79 | 6.79 | 6.79 | 6.79 | 6.79 | 6.79 | 6.79 |
| KV100°C, cSt | D445 | 9.24 | 10.19 | 9.28 | 10.04 | 9.846 | 10.09 | 9.91 | 9.91 | |
| KV40°C, cSt | D445 | | | | | | | | | |
| HTHS 150°C, cP | D4683 | 2.90 | 2.94 | 2.91 | 2.91 | 2.98 | 3.01 | 2.94 | 2.95 | |
| CCS-35°C, cP | D5293 | 6890 | 4020 | 6520 | 3530 | | | 7150 | 7500 | |
| CCS-30°C, cP | D5293 | | | | | 7620 | 4780 | | | 6701 |
| MRV @ -40°C | D4684 | 19500 | 15700 | 17400 | 13300 | | | 21700 | 19100 | |
| Yield Stress @ -40°C | D4684 | <35 | <35 | <35 | <35 | | | <35 | <35 | |
| MRV @ -35°C | D4684 | | | | | 24400 | 15900 | | | |
| Yield Stress @ -35°C | D4684 | | | | | <35 | <35 | | | |
| Noack Loss, % | D5800 | 7.35 | 10.4 | | | | | 11.1 | | |
| Pour Point, °C | D97 | -42 | -54 | -51 | -54 | -42 | -45 | -51 | -51 | |
| Gelation Index | D5133 | 7.6 | 6.1 | 6 | <6 | 6.7 | 6.8 | <6 | <6 | |
| Gelation Temperature | D5133 | -18.3 | -18.6 | -19.1 | - | -16.8 | -18.4 | - | - | |

Fig. 7

| | | Comparative Example 7 | Comparative Example 8 | Inventive Example 4 |
|---|---|---|---|---|
| C28 Methylparaffin, % | | 0 | 0 | 5 |
| Group IV - 4, % | | 21.71 | 21.71 | 21.71 |
| Group III - C6, % | | 23.97 | 4.77 | 3.97 |
| Group III - C4, % | | 0 | 19.2 | 15 |
| Group II - 4.5, % | | 38.15 | 38.15 | 38.15 |
| Group V - A, % | | 5 | 5 | 5 |
| Solid VM, % | | 0.78 | 0.78 | 0.78 |
| Additive System 2, % | | 10.39 | 10.39 | 10.39 |
| Total, % | | 100 | 100 | 100 |
| Base Oil Viscosity, 100°C | D445 | 4.93 | 4.45 | 4.45 |
| SAE Viscosity Grade | | 5W-30 | 0W-30 | 5W-30 |
| Calcium, % | D5185 | 0.110 | 0.110 | 0.110 |
| Magnesium, % | D5185 | 0.077 | 0.077 | 0.077 |
| Boron, % | D5185 | 0.010 | 0.010 | 0.010 |
| Phosphorus, % | D5185 | 0.076 | 0.076 | 0.076 |
| Zinc, % | D5185 | 0.083 | 0.083 | 0.083 |
| Molybdenum, % | D5185 | 0.008 | 0.008 | 0.008 |
| sulfated Ash, % | D874 | 0.917 | 0.917 | 0.917 |
| TBN, mgKOH/g | D2896 | 9.0 | 9.0 | 9.0 |
| TBN, mgKOH/g | D4739 | 7.2 | 7.2 | 7.2 |
| | | | | |
| KV100 | D445 | 10.82 | 10.88 | 10.94 |
| HTHS | D4683 | 3.04 | 2.89 | 2.81 |
| CCS-35 | D5293 | 8120 | 5660 | 6280 |
| Pour Point | D97 | -39 | -54 | -36 |
| MRV -40 °C | D4684 | 29700 | | 39600 |
| Yield Stress -40 °C | D4684 | <35 | | <35 |
| Teost 33C | D6335 | 27.4 | | 30.8 |
| Gelation Index | D5133 | | | 7.7 |
| Gelation Temp | D5133 | | | -17.6 |

Fig. 8

| | | Comparative Example 9 | Comparative Example 10 | Comparative Example 11 | Comparative Example 12 | Comparative Example 13 | Comparative Example 14 | Comparative Example 15 | Comparative Example 16 | Inventive Example 5 | Inventive Example 6 | Inventive Example 7 | Inventive Example 8 |
|---|---|---|---|---|---|---|---|---|---|---|---|---|---|
| C28 Methylparaffin, % | | 0 | 0 | 0 | 0 | 0 | 0 | 0 | 0 | 5 | 5 | 5 | 5 |
| Group IV - 4, % | | 0 | 0 | 0 | 50 | 0 | 0 | 0 | 50.2 | 0 | 46.87 | 0 | 50.27 |
| Group IV - 6, % | | 0 | 0 | 68.47 | 15.47 | 0 | 0 | 65.77 | 11.77 | 0 | 0 | 0 | 0 |
| Group III - A4, % | | 30 | 55.8 | 0 | 0 | 31 | 60.1 | 0 | 0 | 43.47 | 0 | 52.07 | 0 |
| Group III - A8, % | | 48.47 | 19.67 | 0 | 0 | 37.27 | 4.87 | 13 | 13 | 21 | 0 | 0 | 20.5 |
| Group III - B6, % | | 0 | 0 | 10 | 10 | 10 | 10 | 0 | 0 | 0 | 23.5 | 17.5 | 0 |
| Group V - B, % | | 5 | 5 | 5 | 5 | 5 | 5 | 5 | 5 | 5 | 5 | 5 | 5 |
| VM, % | | 3.5 | 6.5 | 3.5 | 6.5 | 3.7 | 7 | 3.2 | 7 | 6.5 | 6.6 | 7.4 | 6.2 |
| Additive System 3, % | | 13.03 | 13.03 | 13.03 | 13.03 | 13.03 | 13.03 | 13.03 | 13.03 | 13.03 | 13.03 | 13.03 | 13.03 |
| Total | | 100 | 100 | 100 | 100 | 100 | 100 | 100 | 100 | 100 | 100 | 100 | 100 |
| Base Oil Viscosity, 100°C, cSt | D445 | 5.31 | 4.79 | 5.79 | 4.66 | 5.74 | 4.52 | 5.97 | 4.81 | 4.80 | 4.7 | 4.5 | 4.8 |
| Viscosity Grade | | 5W-30 | 0W-30 | 5W-30 | 0W-30 | 5W-30 | 0W-30 | 5W-30 | 0W-30 | 5W-30 | 5W-30 | 5W-30 | 5W-30 |
| Base Oil Viscosity, 40°C, cSt | D445 | 30.5 | | 30.0 | | 29.5 | | 31.1 | | 23.7 | 23.2 | 21.9 | 23.7 |
| Calcium, % | D5185 | 0.22 | 0.22 | 0.22 | 0.22 | 0.22 | 0.22 | 0.22 | 0.22 | 0.22 | 0.215 | 0.215 | 0.215 |
| Magnesium, % | D5185 | 0.00 | 0.00 | 0.00 | 0.00 | 0.00 | 0.00 | 0.00 | 0.00 | 0.00 | 0 | 0 | 0 |
| Boron, % | D5185 | 0.010 | 0.010 | 0.010 | 0.010 | 0.010 | 0.010 | 0.010 | 0.010 | 0.010 | 0.010 | 0.010 | 0.010 |
| Phosphorus, % | D5185 | 0.08 | 0.08 | 0.08 | 0.08 | 0.08 | 0.08 | 0.08 | 0.08 | 0.08 | 0.076 | 0.076 | 0.076 |
| Zinc, % | D5185 | 0.08 | 0.08 | 0.08 | 0.08 | 0.08 | 0.08 | 0.08 | 0.08 | 0.08 | 0.083 | 0.083 | 0.083 |
| Molybdenum, % | D5185 | 0.016 | 0.016 | 0.016 | 0.016 | 0.016 | 0.016 | 0.016 | 0.016 | 0.016 | 0.016 | 0.016 | 0.016 |
| sulfated Ash, % | D874 | 0.94 | 0.94 | 0.94 | 0.94 | 0.94 | 0.94 | 0.94 | 0.94 | 0.94 | 0.941 | 0.941 | 0.941 |
| TBN, mgKOH/g | D2896 | 8.70 | 8.70 | 8.70 | 8.70 | 8.70 | 8.70 | 8.70 | 8.70 | 8.70 | 8.704 | 8.704 | 8.704 |
| TBN, mgKOH/g | D4739 | 6.83 | 6.83 | 6.83 | 6.83 | 6.83 | 6.83 | 6.83 | 6.83 | 6.83 | 6.826 | 6.826 | 6.826 |
| KV100 | D445/D7279 | 9.701 | 10.2 | 9.577 | 10.0 | 9.422 | 10.2 | 9.591 | 10.8 | 10.03 | 10.08 | 10.31 | 9.861 |
| KV40 | D445/D7279 | 55.7 | 56.4 | 54.92 | 54.6 | 54.74 | 55.4 | 55.23 | 58.9 | 54.07 | 54.67 | 55.24 | 52.52 |
| HTHS | D4683 | 3.01 | 2.99 | 2.95 | 2.88 | 2.99 | 3.02 | 2.96 | 3.16 | 2.99 | 2.997 | 2.98 | 2.927 |
| CCS-35 | D5293 | 8670 | 5490 | 6300 | 4270 | 8550 | 5080 | 7110 | 4510 | 7680 | 6260 | 7520 | 6700 |
| CCS-30 | D5293 | | | | | | | | | 3050 | | 3080 | |
| MRV @ -40 °C | D4684 | 22700 | 19100 | 18200 | 14700 | 22500 | 18100 | 18500 | 16300 | 22500 | 20600 | 23800 | 18300 |
| Yield Stress @ -40 °C | D4684 | <35 | <35 | <35 | <35 | <35 | <35 | <35 | <35 | <35 | <35 | <35 | <35 |
| Pour Point | D97 | -51 | -54 | -51 | -54 | -51 | -48 | -51 | -51 | -42 | -45 | -42 | -51 |
| Gelation Index | D5133 | <6 | 6.5 | 7.1 | 6 | 7.5 | 7.3 | 7.6 | BL | <6 | <6 | <6 | <6 |
| Gelation Temperature | D5133 | - | -17.6 | -18.5 | -18.3 | -17.4 | -17.4 | -18.8 | BL | - | - | - | - |
| TEOST 33C | D6335 | 8.1 | BL | 6.4 | BL | 7 | BL | 6.4, 5.4 | BL | 8.8 | 28.6 | 7.8 | 8.3 |
| LTPT EOT MRV @ -40 °C | CEC L105 | 27300 | 23400 | 19900 | 17100 | 27300 | 22100 | 18600 | 19000 | 26100 | | 25700 | 21600 |
| LTPT EOT Yield Stress @ -40 °C | CEC L105 | <35 | <35 | <35 | <35 | <35 | <35 | <35 | <35 | <35 | | <35 | <35 |
| LTPT EOT MRV @ -35 °C | CEC L105 | 13000 | 11300 | 9900 | 8700 | 13000 | 10400 | 9400 | 9300 | 11800 | | 11900 | 9900 |
| LTPT EOT Yield Stress @ -35 °C | CEC L105 | <35 | <35 | <35 | <35 | <35 | <35 | <35 | <35 | <35 | | <35 | <35 |
| ROBO AGED MRV @-35 °C | D7528 | | | | | | | 10600 | | | | | 12000 |
| ROBO AGED Yield Stress @ -35 °C | D7528 | | | | | | | <35 | | | | | <35 |
| ROBO AGED KV40°C Viscosity Incr | D7528 | | | | | | | 18 | | | | | 11 |

Fig. 9

| | | Comparative Example 17 | Comparative Example 18 | Comparative Example 19 | Comparative Example 20 | Comparative Example 21 | Comparative Example 22 | Inventive Example 9 | Inventive Example 10 | Inventive Example 11 | Inventive Example 12 | Inventive Example 13 | Inventive Example 14 | Inventive Example 15 |
|---|---|---|---|---|---|---|---|---|---|---|---|---|---|---|
| Decyl Palmitate, % | | 0 | 0 | 0 | 0 | 0 | 0 | 5 | 5 | 5 | 5 | 5 | 5 | 0 |
| Coconut Oil, % | | 0 | 0 | 0 | 0 | 0 | 0 | 0 | 0 | 0 | 0 | 0 | 0 | 5 |
| Group II - 4, % | | 38.46 | 44.46 | 0 | 0 | 0 | 0 | 14.96 | 58.96 | 0 | 0 | 0 | 0 | 0 |
| Group II - 6, % | | 0 | 20 | 0 | 0 | 0 | 0 | 0 | 5.5 | 0 | 0 | 0 | 0 | 0 |
| Group III - A4, % | | 25 | 0 | 0 | 0 | 37.1 | 5.46 | 48 | 0 | 25 | 0 | 50.2 | 17.46 | 54.46 |
| Group III - A8, % | | 0 | 0 | 0 | 0 | 29.26 | 65 | 0 | 0 | 0 | 0 | 13.26 | 50 | 9 |
| Group III - B4, % | | 0 | 0 | 53.46 | 7.46 | 0 | 0 | 0 | 0 | 37.96 | 28.46 | 0 | 0 | 0 |
| Group III - B6, % | | 0 | 0 | 10 | 60 | 0 | 0 | 0 | 0 | 0 | 37 | 0 | 0 | 0 |
| Group IV - 4, % | | 10 | 10 | 10 | 10 | 10 | 10 | 10 | 10 | 10 | 10 | 10 | 10 | 10 |
| Group V - A, % | | 5 | 5 | 5 | 5 | 5 | 5 | 0 | 0 | 0 | 0 | 0 | 0 | 0 |
| VM, % | | 7 | 6 | 7 | 3 | 4.1 | 0 | 7.5 | 6 | 7.5 | 5 | 7 | 3 | 7 |
| Additive System X, % | | 14.54 | 14.54 | 14.54 | 14.54 | 14.54 | 14.54 | 14.54 | 14.54 | 14.54 | 14.54 | 14.54 | 14.54 | 14.54 |
| Total | | 100 | 100 | 100 | 100 | 100 | 100 | 100 | 100 | 100 | 100 | 100 | 100 | 100 |
| Base Oil Viscosity, 100°C, cSt | Modeled | 4.38 | 4.96 | 4.48 | 5.76 | 5.18 | 6.66 | 4.13 | 4.54 | 4.10 | 5.02 | 4.49 | 5.90 | 4.51 |
| Viscosity Grade | | 5W-30 | 10W-30 | 5W-30 | 10W-30 | 5W-30 | 10W-30 | 5W-30 | 10W-30 | 5W-30 | 10W-30 | 5W-30 | 10W-30 | 5W-30 |
| Base Oil Viscosity, 40°C, cSt | Modeled | 21.01 | 26.28 | 21.44 | 31.11 | 25.81 | 36.73 | 18.43 | 22.13 | 18.21 | 24.78 | 20.50 | 30.22 | 20.82 |
| Calcium, ppm | D5185 | 1480 | 1470 | 1520 | 1520 | 1480 | 1510 | 1510 | 1510 | 1510 | 1510 | 1540 | 1500 | 1530 |
| Magnesium, ppm | D5185 | 967 | 964 | 975 | 899 | 1010 | 828 | 992 | 975 | 947 | 960 | 979 | 957 | 953 |
| Boron, ppm | D5185 | 270 | 270 | 270 | 260 | 250 | 270 | 250 | 260 | 260 | 260 | 270 | 260 | 260 |
| Phosphorus, ppm | D5185 | 745 | 748 | 764 | 715 | 751 | 739 | 739 | 756 | 741 | 741 | 774 | 748 | 755 |
| Zinc, ppm | D5185 | 833 | 833 | 840 | 805 | 843 | 851 | 833 | 833 | 831 | 831 | 858 | 833 | 833 |
| Molybdenum, ppm | D5185 | 200 | 200 | 200 | 200 | 200 | 200 | 200 | 200 | 200 | 200 | 200 | 200 | 200 |
| KV100 | D445 | 10.56 | 11.08 | 10.79 | 9.969 | 9.548 | 9.29 | 10.18 | 10.2 | 10.13 | 10.14 | 10.25 | 9.959 | 10.36 |
| KV40 | D445 | 58.69 | 67.09 | 59.56 | 59.81 | 53.44 | 56.56 | 53.29 | 57.28 | 52.71 | 56.6 | 54.64 | 56.39 | 55.39 |
| HTHS150 | D4683 | 3.07 | 3.24 | 3.15 | 3.12 | 3.05 | 3.03 | 2.94 | 3.05 | 2.98 | 3.11 | 3.03 | 3.12 | 3.06 |
| CCS-25 | D5293 | -- | 3690 | -- | 3870 | -- | 4000 | -- | 3810 | -- | 3800 | -- | 4200 | -- |
| CCS-30 | D5293 | 3980 | 6850 | 4150 | 7250 | 4320 | 7150 | 4090 | 7120 | 4130 | 7140 | | 7350 | 4350 |
| CCS-35 | D5293 | 7570 | -- | 8130 | -- | 7820 | -- | 7490 | -- | 7740 | -- | 7810 | -- | 7800 |
| Pour Point, °C | D97 | -42 | -39 | -39 | -33 | -51 | -51 | -27 | -39 | -39 | -33 | | -48 | -45 |
| Gelation Index | D5133 | <6 | <6 | 7 | 8.1 | | <6 | <6 | <6 | <6 | 7.6 | <6 | <6 | <6 |
| Gelation Temperature | D5133 | - | - | -38.3 | -37.3 | | - | - | - | - | -36.6 | - | - | - |

Fig. 10

| | | Comparative Example 21 | Inventive Example 16 | Inventive Example 13 | Inventive Example 17 | Inventive Example 18 |
|---|---|---|---|---|---|---|
| Decyl Palmitate, % | | 0 | 2 | 5 | 8 | 12 |
| Coconut Oil, % | | 0 | 0 | 0 | 0 | 0 |
| Group II - 4, % | | 0 | 0 | 0 | 0 | 0 |
| Group II - 6, % | | 0 | 0 | 0 | 0 | 0 |
| Group III - A4, % | | 37.1 | 40.7 | 50.2 | 49 | 47.7 |
| Group III - A8, % | | 29.26 | 28.26 | 13.26 | 11.26 | 8.26 |
| Group III - B4, % | | 0 | 0 | 0 | 0 | 0 |
| Group III - B6, % | | 0 | 0 | 0 | 0 | 0 |
| Group IV - 4, % | | 10 | 10 | 10 | 10 | 10 |
| Group V - A, % | | 5 | 0 | 0 | 0 | 0 |
| VM, % | | 4.1 | 4.5 | 7 | 7.2 | 7.5 |
| Additive System X, % | | 14.54 | 14.54 | 14.54 | 14.54 | 14.54 |
| Total | | 100 | 100 | 100 | 100 | 100 |
| Base Oil Viscosity, 100°C, cSt | Modeled | 5.18 | 5.07 | 4.49 | 4.38 | 4.22 |
| Viscosity Grade | | 5W-30 | 5W-30 | 5W-30 | 5W-30 | 5W-30 |
| Base Oil Viscosity, 40°C, cSt | Modeled | 25.81 | 24.55 | 20.50 | 19.63 | 18.45 |
| Calcium, ppm | D5185 | 1480 | 1560 | 1540 | 1510 | 1530 |
| Magnesium, ppm | D5185 | 1010 | 998 | 979 | 980 | 988 |
| Boron, ppm | D5185 | 250 | 260 | 270 | 260 | 260 |
| Phosphorus, ppm | D5185 | 751 | 729 | 774 | 744 | 755 |
| Zinc, ppm | D5185 | 843 | 813 | 858 | 828 | 844 |
| Molybdenum, ppm | D5185 | 200 | 200 | 200 | 200 | 200 |
| KV100 | D445 | 9.548 | 9.656 | 10.25 | 10.21 | 10.12 |
| KV40 | D445 | 53.44 | 52.4 | 54.64 | 53.03 | 51.58 |
| HTHS150 | D4683 | 3.05 | 2.96 | 3.03 | 3.04 | 3.03 |
| CCS-25 | D5293 | -- | -- | -- | -- | -- |
| CCS-30 | D5293 | 4320 | 4440 | | 4580 | 4480 |
| CCS-35 | D5293 | 7820 | 7950 | 7810 | 7910 | 8400 |
| Pour Point, °C | D97 | -51 | -48 | | 3 | 6 |
| Gelation Index | D5133 | -- | <6 | <6 | <NoResult> | <NoResult> |
| Gelation Temperature | D5133 | | - | - | - | - |

METHOD FOR IMPROVING ENGINE FUEL EFFICIENCY AND ENERGY EFFICIENCY

CROSS-REFERENCE TO RELATED APPLICATIONS

This application claims priority to U.S. Provisional Application Ser. No. 62/475,980 filed Mar. 24, 2017, which is herein incorporated by reference in its entirety.

FIELD

This disclosure relates to a method for improving fuel efficiency and energy efficiency, while maintaining or improving deposit control and cleanliness performance, in an engine lubricated with the lubricating oil. This disclosure also relates to a lubricating oil having a lubricating oil base stock as a major component, and at least one cobase stock, as a minor component.

BACKGROUND

Fuel efficiency and energy efficiency requirements for passenger vehicles are becoming increasingly more stringent. New legislation in the United States and European Union within the past few years has set fuel economy and emissions targets not readily achievable with today's vehicle and lubricant technology.

Over the last decade, the global trend toward tighter carbon dioxide emission regulations has resulted in automobile manufacturers requiring higher levels of fuel economy performance for engine oils. One of the changes car makers are imposing is a slow but steady shift toward lower viscosity grade engine oils such as SAE 0W-20 and SAE 0W-16. Despite this trend, SAE 5W-20, 5W-30, and 10W-30 oils are still key viscosity grades used by many autobuilders and widely sold in the marketplace. Therefore, strategies to improve fuel economy for "5W" and 10W viscosity grade engine oils are of paramount importance to meet tightening fuel economy requirements of new engine oil specifications.

To address these increasing standards, automotive original equipment manufacturers are demanding better fuel economy as a lubricant-related performance characteristic, while maintaining deposit control requirements. One well known way to increase fuel economy is to decrease the viscosity of the lubricating oil. However, this approach is now reaching the limits of current equipment capabilities and specifications. At a given viscosity, it is well known that adding organic or organo-metallic friction modifiers reduces the surface friction of the lubricating oil and allows for better fuel economy. However these additives often bring with them detrimental effects such as increased deposit formation, seals impacts, or they out-compete the antiwear components for limited surface sites, thereby not allowing the formation of an antiwear film, causing increased wear.

Contemporary lubricants such as engine oils use mixtures of additives such as dispersants, detergents, inhibitors, viscosity index improvers and the like to provide engine cleanliness and durability under a wide range of performance conditions of temperature, pressure, and lubricant service life.

Lubricant-related performance characteristics such as high temperature deposit control and fuel economy are extremely advantageous attributes as measured by a variety of bench and engine tests. As indicated above, it is known that adding organic friction modifiers to a lubricant formulation imparts frictional benefits at low temperatures, consequently improving the lubricant fuel economy performance. At high temperatures, however, adding increased levels of organic friction modifier can invite high temperature performance issues. For example, engine deposits are undesirable consequences of high levels of friction modifier in an engine oil formulation at high temperature engine operation.

Improved energy efficiency is of paramount importance to nearly all automobile and equipment manufacturers. Improved fuel economy and energy efficiency can often be achieved by using lower viscosity lubricants or by reducing the kinematic viscosity at 100° C. of the base oil mixture used to formulate an engine oil (Crosthwait et al. "The Effect of High Quality Base Stocks on PCMO Fuel Economy" LW-99-126), however often the higher volatility of such lower viscosity fluids becomes an issue. While there are efforts to develop low viscosity, low volatility base stocks, such fluids will likely produce SAE 5W-30, SAE 5W-20, and SAE 10W-30 oils with very high base oil kinematic viscosity at 100° C. Such oils would struggle to meet industry fuel economy requirements because of a very Newtonian character. SAE 5W-30 and SAE 5W-20 viscosity grades currently represent a large volume of lubricants sold in the United States, therefore low viscosity, low volatility base stocks having improved the fuel economy and energy efficiency of these viscosity grades, without compromising other performance characteristics, are of significant business value.

A major challenge in engine oil formulation is simultaneously achieving high temperature deposit control while also achieving improved fuel economy.

Despite the advances in lubricant oil formulation technology, there exists a need for engine oil lubricants that effectively improve fuel economy while maintaining or improving deposit control.

The present disclosure also provides many additional advantages, which shall become apparent as described below.

SUMMARY

This disclosure relates to a lubricating oil having a mixture of a lubricating oil base stock as a major component, and at least one cobase stock, as a minor component. The at least one cobase stock is present in an amount sufficient to reduce kinematic viscosity (Kv100) of the base oil mixture as determined by ASTM D445, while maintaining or controlling cold cranking simulator viscosity (CCSV) of the lubricating oil as determined by ASTM D5293-15, such that the lubricating oil meets both kinematic viscosity (Kv100) and cold cranking simulator viscosity (CCSV) requirements for a SAE engine oil grade as determined by SAE J300 viscosity grade classification system. This disclosure also relates to a method for improving fuel efficiency and energy efficiency, while maintaining or improving deposit control and cleanliness performance, in an engine lubricated with the lubricating oil.

In particular, this disclosure relates in part to a method for improving fuel efficiency and energy efficiency, while maintaining or improving deposit control and cleanliness performance, in an engine lubricated with a lubricating oil by using as the lubricating oil a formulated oil. The formulated oil comprises a base oil mixture in which the base oil mixture comprises a lubricating oil base stock as a major component, and at least one cobase stock, as a minor component. The at least one cobase stock is present in an amount sufficient to reduce kinematic viscosity (Kv100) of the base oil mixture as determined by ASTM D445, while maintaining or controlling cold cranking simulator viscosity (CCSV) of the lubricating oil as determined by ASTM D5293-15, such that the lubricating oil meets both kinematic viscosity (Kv100) and cold cranking simulator viscosity (CCSV) requirements for a SAE engine oil grade as determined by SAE J300 viscosity grade classification system. Fuel efficiency and energy efficiency are improved and deposit control and cleanliness performance are maintained or improved as compared to fuel efficiency, energy efficiency, deposit control and cleanliness performance achieved using a lubricating oil containing a minor component other than the cobase stock, the lubricating oils having comparable cold cranking simulator viscosities (CCSVs) as determined by ASTM D5293-15 and high temperature high shear (HTHS) viscosities as determined by ASTM D4683-13.

Further, in particular, this disclosure also relates in part to a lubricating oil comprising a base oil mixture. The base oil mixture comprises a lubricating oil base stock as a major component, and at least one cobase stock, as a minor component. The at least one cobase stock is present in an amount sufficient to reduce kinematic viscosity (Kv100) of the base oil mixture as determined by ASTM D445, while maintaining or controlling cold cranking simulator viscosity (CCSV) of the lubricating oil as determined by ASTM D5293-15, such that the lubricating oil meets both kinematic viscosity (Kv100) and cold cranking simulator viscosity (CCSV) requirements for a SAE engine oil grade as determined by SAE J300 viscosity grade classification system.

It has been surprisingly found that improvements in fuel economy and energy efficiency are obtained without sacrificing engine durability (e.g., while maintaining or improving deposit control and cleanliness performance) in an engine lubricated with a lubricating oil, by using as the lubricating oil a formulated oil having a base oil mixture including at least one cobase stock in an amount from about 2 weight percent to about 12 weight percent, based on the total weight of the lubricating oil, to reduce kinematic viscosity (Kv100) of the base oil mixture as determined by ASTM D445, while maintaining or controlling cold cranking simulator viscosity (CCSV) of the lubricating oil as determined by ASTM D5293-15, such that the lubricating oil meets both kinematic viscosity (Kv100) and cold cranking simulator viscosity (CCSV) requirements for a SAE engine oil grade as determined by SAE J300 viscosity grade classification system.

Also, it has been surprisingly found that outstanding low viscosity low volatility properties, desired cold cranking simulator viscosity (CCSV), good high-temperature deposit control, and traction benefits, can be attained in an engine lubricated with a lubricating oil by using as the lubricating oil a formulated oil in accordance with this disclosure. In particular, a lubricating oil having a base oil mixture including at least one cobase stock, in which the cobase stock is a dimerized, hydrogenated C14 linear alphaolefin having a kinematic viscosity (Kv100) less than about 4 cSt at 100° C. as determined by ASTM D445, exhibits low kinematic viscosity (Kv100), desired cold cranking simulator viscosity (CCSV), low volatility, desired deposit control and traction benefits. The cobase stocks may also be decyl palmitate, coconut oil or C18 dimer. Such properties help to prolong the useful life of lubricants and significantly improve the durability and resistance of lubricants when exposed to high temperatures. The lubricating oils of this disclosure are particularly advantageous as passenger vehicle engine oil (PVEO) products and commercial vehicle engine oil (CVEO) products.

Further objects, features and advantages of the present disclosure will be understood by reference to the following drawings and detailed description.

BRIEF DESCRIPTION OF THE DRAWINGS

FIG. 3 shows properties of a cobase stock of this disclosure (i.e., C28 methyl paraffin, decyl palmitate, coconut oil and C18 dimer).

FIG. 5 shows typical properties of base stocks used in the Examples.

FIG. 6 shows lubricating oil formulations and properties of the lubricating oil formulations used in the Examples.

FIG. 7 shows lubricating oil formulations and properties of the lubricating oil formulations used in the Examples.

FIG. 8 shows lubricating oil formulations and properties of the lubricating oil formulations used in the Examples.

FIG. 9 shows additional lubricating oil formulations and properties of the lubricating oil formulations used in the Examples.

FIG. 10 shows yet additional lubricating oil formulations and properties of the lubricating oil formulations used in the Examples.

DETAILED DESCRIPTION

Figure 1:
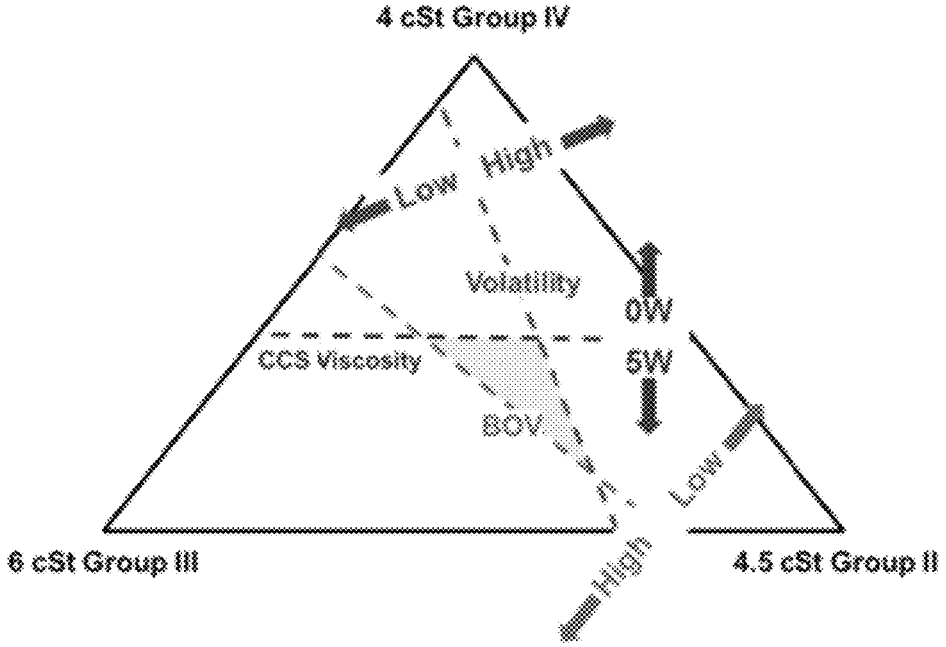
FIG. 1 graphically shows a blending window enabled by a conventional base stock formulating approach to make a SAE 5W-xx engine oil in combination with higher viscosity base stocks in accordance with Example 1.

All numerical values within the detailed description and the claims herein are modified by "about" or "approximately" the indicated value, and take into account experimental error and variations that would be expected by a person having ordinary skill in the art. The phrase "major amount" or "major component" as it relates to components included within the lubricating oils of the specification and the claims means greater than or equal to 50 wt. %, or greater than or equal to 60 wt. %, or greater than or equal to 70 wt. %, or greater than or equal to 80 wt. %, or greater than or equal to 90 wt. % based on the total weight of the lubricating oil. The phrase "minor amount" or "minor component" as it relates to components included within the lubricating oils of the specification and the claims means less than 50 wt. %, or less than or equal to 40 wt. %, or less than or equal to 30 wt. %, or greater than or equal to 20 wt. %, or less than or equal to 10 wt. %, or less than or equal to 5 wt. %, or less than or equal to 2 wt. %, or less than or equal to 1 wt. %, based on the total weight of the lubricating oil. The phrase "essentially free" as it relates to components included within the lubricating oils of the specification and the claims means that the particular component is at 0 weight % within the lubricating oil, or alternatively is at impurity type levels within the lubricating oil (less than 100 ppm, or less than 20 ppm, or less than 10 ppm, or less than 1 ppm). The phrase "other lubricating oil additives" as used in the specification and the claims means other lubricating oil additives that are not specifically recited in the particular section of the specification or the claims. For example, other lubricating oil additives may include, but are not limited to, an anti-wear additive, viscosity improver or modifier, antioxidant, detergent, dispersant, pour point depressant, corrosion inhibitor, metal deactivator, seal compatibility additive, anti-foam agent, inhibitor, anti-rust additive, friction modifier and combinations thereof.

As used herein, "controlling" CCSV of the lubricating oil refers to not significantly increasing or decreasing CCSV, such that the lubricating oil meets both kinematic viscosity (Kv100) and CCSV requirements for a SAE engine oil grade as determined by SAE J300 viscosity grade classification system.

In accordance with this disclosure, a new lubricant blending strategy is provided for improved fuel economy and energy efficiency. In particular, the lubricant blending strategy uses a pure 3.5 cSt (Kv100) dimerized, hydrogenated C14 linear alpha olefin, blended with high-quality, low-viscosity Group II, Group III, and/or Group IV base stocks. Using low amounts (e.g., 3-10 wt %) of this synthetic wax can provide a >1 cSt decrease in base oil viscosity when blended in an SAE 5W-30, 5W-20, 5W-16, or 10W-30 engine oil, while maintaining or controlling other key low-temperature performance areas such as CCSV. Additionally, substantial fuel economy savings over traditional SAE 5W-30 oils blended with Group II base stocks have been observed using lubricant blending models. The use of high quality Group III and IV base stocks also provides additional performance gains in oxidation stability, viscosity index, and deposit control.

Also, in accordance with this disclosure, a method is provided for improving fuel efficiency and energy efficiency, while maintaining or improving deposit control and cleanliness performance, in an engine lubricated with a lubricating oil by using as the lubricating oil a formulated oil. The formulated oil comprises a base oil mixture in which the base oil mixture comprises a lubricating oil base stock as a major component, and at least one cobase stock, as a minor component. The at least one cobase stock is present in an amount sufficient to reduce kinematic viscosity (Kv100) of the base oil mixture as determined by ASTM D445, while maintaining or controlling cold cranking simulator viscosity (CCSV) of the lubricating oil as determined by ASTM D5293-15, such that the lubricating oil meets both kinematic viscosity (Kv100) and cold cranking simulator viscosity (CCSV) requirements for a SAE engine oil grade as determined by SAE J300 viscosity grade classification system. Fuel efficiency and energy efficiency are improved and deposit control and cleanliness performance are maintained or improved as compared to fuel efficiency, energy efficiency, deposit control and cleanliness performance achieved using a lubricating oil containing a minor component other than the cobase stock, the lubricating oils having comparable cold cranking simulator viscosities (CCSVs) as determined by ASTM D5293-15 and high temperature high shear (HTHS) viscosities as determined by ASTM D4683-13.

Further, in accordance with this disclosure, a lubricating oil is provided comprising a base oil mixture. The base oil mixture comprises a lubricating oil base stock as a major component, and at least one cobase stock, as a minor component. The at least one cobase stock is present in an amount sufficient to reduce kinematic viscosity (Kv100) of the base oil mixture as determined by ASTM D445, while maintaining or controlling cold cranking simulator viscosity (CCSV) of the lubricating oil as determined by ASTM D5293-15, such that the lubricating oil meets both kinematic viscosity (Kv100) and cold cranking simulator viscosity (CCSV) requirements for a SAE engine oil grade as determined by SAE J300 viscosity grade classification system. The at least one cobase stock has a kinematic viscosity (Kv100) less than about 4 cSt at 100° C. as determined by ASTM D445. The at least one cobase stock comprises a Group IV cobase stock, a Group V cobase stock, or mixtures thereof.

Preferably, the at least one cobase stock is a C20-36 polyalphaolefin, a C24-32 polyalphaolefin, a C24-28 polyalphaolefin, or mixtures thereof, and has from about 1 to about 4 branch points. Also, preferably, the at least one cobase stock is a polyalphaolefin derived from C8, C10, C12, C14 olefins, or mixtures thereof, and having from about 1 to about 4 branch points. More preferably, the at least one cobase stock is a dimerized, hydrogenated C14 linear alphaolefin having a kinematic viscosity (Kv100) less than about 4 cSt at 100° C. as determined by ASTM D445. Preferably the at least one cobase stock maybe decyl palmitate, coconut oil and C18 dimer.

In accordance with this disclosure, the lubricating oil base stock comprises a Group II base stock, Group III base stock, a Group IV base stock, or mixtures thereof. The lubricating oil of this disclosure is preferably a SAE 5W-16 engine oil, SAE 5W-20 engine oil, a SAE 5W-30 engine oil, or a SAE 10W-30 engine oil.

In an embodiment, kinematic viscosity (Kv100) of the base oil mixture used to formulate a lubricating oil as determined by ASTM D445 is reduced, as compared to kinematic viscosity (Kv100) of the base oil mixture used to formulate a lubricating oil as determined by ASTM D445 containing a minor component other than the cobase stock, the lubricating oils having comparable cold cranking simulator (CCS) viscosities as determined by ASTM D5293-15 and high temperature high shear (HTHS) viscosities as determined by ASTM D4683-13

In a preferred embodiment, the kinematic viscosity (Kv100) of the base oil mixture used to formulate a lubricating oil as determined by ASTM D445 is reduced by greater than about 0.5 cSt, preferably greater than about 1 cSt, more preferably greater than about 2 cSt, and even more preferably greater than about 2.5 cSt.

In another embodiment, Noack volatility of the lubricating oil as determined by ASTM D5800 is reduced, as compared to Noack volatility of a lubricating oil as determined by ASTM D5800 containing a minor component other than the cobase stock, the lubricating oils having comparable cold cranking simulator (CCS) viscosities as determined by ASTM D5293-15 and high temperature high shear (HTHS) viscosities as determined by ASTM D4683-13.

In a preferred embodiment, the Noack volatility of the lubricating oil as determined by ASTM D5800 is reduced by about 0.5 to about 2.5 weight percent.

The viscometric properties of the lubricants of this disclosure can be measured according to standard practices. A low viscosity can be advantageous for lubricants in modern equipment. A low high temperature high shear (HTHS) viscosity, in accordance with ASTM D4683-13, can indicate performance of a lubricant in a modern engine.

A cold cranking simulator (CCS) viscosity test as determined by ASTM D5293-15 evaluates the amount of energy it takes to start an engine at a specified cold temperature; the lower the viscosity grade, the lower the temperature at which the test is performed. The test assigns a value in cP, used to determine the viscosity grade. Using a 5W-30 lubricant, for example, its CCSV at −30° C. can be no greater than 6600 cP to receive a 5W grade.

The lubricating oil of this disclosure has a kinematic viscosity (Kv100) from about 2 cSt to about 12.5 cSt at 100° C. as determined by ASTM D445, a cold cranking simulator (CCS) viscosity at −35° C. from about 1000 cP to about 6200 cP as determined by ASTM D5293-15 (0W SAE Grade), or a cold cranking simulator (CCS) viscosity at −30° C. from about 1000 cP to about 6600 cP as determined by ASTM D5293-15 (5W SAE Grade), or a cold cranking simulator (CCS) viscosity at −25° C. from about 1000 cP to about 7000 cP as determined by ASTM D5293-15 (10W SAE Grade), and a high temperature high shear (HTHS) viscosity of less than about 3.5 cP as determined by ASTM D4683-13. The lubricating oil meets both kinematic viscosity (Kv100) and cold cranking simulator (CCS) viscosity requirements for a SAE engine oil grade as determined by SAE J300 viscosity grade classification system.

In an embodiment, the lubricating oils of this disclosure preferably have a kinematic viscosity (Kv100) from about 2 cSt to about 10 cSt, more preferably from about 2 cSt to about 8 cSt, even more preferably from about 2 cSt to about 6 cSt, at 100° C. as determined by ASTM D445, and a high temperature high shear (HTHS) viscosity of less than about 2.5 cP, more preferably less than about 2.25 cP, even more preferably less than about 2.0 cP, as determined by ASTM D4683-13.

In an embodiment, the lubricating oils of this disclosure preferably have a cold cranking simulator (CCS) viscosity at −35° C. from about 1200 cP to about 6200 cP, more preferably from about 1400 cP to about 6200 cP, even more preferably from about 1600 cP to about 6200 cP, as determined by ASTM D5293-15 (0W SAE Grade), a cold cranking simulator (CCS) viscosity at −30° C. from about 1200 cP to about 6600 cP, more preferably from about 1400 cP to about 6600 cP, even more preferably from about 1600 cP to about 6600 cP, as determined by ASTM D5293-15 (5W SAE Grade), and a cold cranking simulator (CCS) viscosity at −25° C. from about 1200 cP to about 7000 cP, more preferably from about 1400 cP to about 7000 cP, even more preferably from about 1600 cP to about 7000 cP, as determined by ASTM D5293-15 (10W SAE Grade).

Illustrative lubricating oils of this disclosure have a viscosity index (VI) from about 80 to about 300, more preferably from about 90 to about 200, even more preferably from about 100 to about 200, as determined by ASTM D2270.

The lubricants of this disclosure have lower volatility, as determined by the Noack volatility test ASTM D5800. In particular, the lubricants of this disclosure have a Noack between 1% and 50%, or more preferably between 3% and 50%, or more preferably between 4% and 40%, or even more preferably between 5% and 30%. Particularly preferred compositions have a Noack between 5% and 15%.

Preferred lubricating oils of this disclosure have a Noack volatility of no greater than 25 percent, more preferably no greater than 20 percent, even more preferably no greater than 15 percent, as determined by ASTM D5800.

The lubricants of this disclosure have reduced traction as determined by the MTM (Mini Traction Machine) traction test. Traction is most easily assessed by comparison to a reference fluid, in this case a suitable reference fluid is an engine oil formulated with PAO 2 or PAO 4. Accordingly, the lubricants of this disclosure can have an MTM traction reduction of 5% versus a reference, or more preferably a reduction of 10% versus a reference, or more preferably a reduction of 20% versus a reference, or more preferably a reduction of 30% versus a reference, or more preferably a reduction of 40% versus a reference.

Using the synthetic wax of this disclosure as a majority or sole base stock provides significant improvements in traction coefficient as measured in the Mini-Traction Machine (MTM). While a formulation with >20% of this material would likely not be able to meet an SAE J300 "5W" or "0W" viscosity grade, such a fluid could be used to provide significant energy efficiency gains in higher temperature applications for which an SAE J300 "W" viscosity grade is not needed (e.g., racing applications or worm gear lubricants for industrial applications).

In an embodiment, the lubricating oil of this disclosure has a MTM traction reduction of greater than about 5% as compared to MTM traction of a lubricating oil containing a minor component other than the cobase stock, as determined by the MTM (Mini Traction Machine) traction test.

The lubricants of this disclosure have lower deposition tendency, as determined by the TEOST 33C deposition test ASTM D6335. In particular, the lubricants of this disclosure can have a TEOST 33C of less than 30 mg, or more preferably less than 20 mg, or more preferably less than 15 mg.

In an embodiment, the lubricating oil of this disclosure is a passenger vehicle engine oil (PVEO) or a commercial vehicle engine oil (CVEO).

This disclosure provides lubricating oils useful as engine oils and in other applications characterized by low viscosity and low volatility. The lubricating oils are based on high quality base stocks including a major portion of a hydrocarbon base fluid such as a Group II, Group III (including GTL), and or Group IV (PAO) with a secondary cobase stock component which when blended, yields an oil composition which meets the following criteria: the oil composition has a kinematic viscosity at 100° C. as determined by ASTM D445 ("KV100") of KV100(oil) and a cold cranking simulator viscosity at a given temperature as determined by ASTM 5293 ("CCSV") of CCSV(oil); the reference oil has a KV100 and CCSV of KV100(ref) and CCSV(ref), respectively, and the following conditions (i) and (ii) are met: (i) $-20 \leq D(kv)=100\times(KV100(oil)-KV100(ref))/KV100(ref) \leq 40$; and (ii) $1 \leq D(ccsv)=100\times(CCSV(oil)-CCSV(ref))/CCSV(ref) \leq 10000$. For further information with regard to secondary cobase stocks, refer to U.S. Provisional Application No. 62/476,017 filed on Mar. 24, 2017, herein incorporated by reference in its entirety.

A PAO with a KV100 of 4 cSt (PAO-4) is a useful reference oil for evaluating the performance of a secondary cobase stock component. Non-limiting exemplary cobase stocks of the instant disclosure include a C20-36 polyalphaolefin, a C24-32 polyalphaolefin, a C24-28 polyalphaolefin, (the polyalphaolefins having from about 1 to about 4 branch points, as described herein), a linear monoester (such as decyl palmitate), a mixture of triglycerides (such as coconut oil), or mixtures thereof. The lubricating oil base stock can be any oil boiling in the lube oil boiling range, typically between about 100 to 450° C. In the present specification and claims, the terms base oil(s) and base stock(s) are used interchangeably.

The viscosity-temperature relationship of a lubricating oil is one of the critical criteria which must be considered when selecting a lubricant for a particular application. Viscosity Index (VI) is an empirical, unitless number which indicates the rate of change in the viscosity of an oil within a given temperature range. Fluids exhibiting a relatively large change in viscosity with temperature are said to have a low viscosity index. A low VI oil, for example, will thin out at elevated temperatures faster than a high VI oil. Usually, the high VI oil is more desirable because it has higher viscosity at higher temperature, which translates into better or thicker lubrication film and better protection of the contacting machine elements.

In another aspect, as the oil operating temperature decreases, the viscosity of a high VI oil will not increase as much as the viscosity of a low VI oil. This is advantageous because the excessive high viscosity of the low VI oil will decrease the efficiency of the operating machine. Thus high VI (HVI) oil has performance advantages in both high and low temperature operation. VI is determined according to ASTM D2270. VI is related to kinematic viscosities measured at 40° C. and 100° C. using ASTM D445.

The lubricating oils of this disclosure provide improved fuel efficiency and energy efficiency. A lower HTHS viscosity engine oil generally provides superior fuel economy to a higher HTHS viscosity product. This benefit can be demonstrated for the lubricating oils of this disclosure in the Sequence VID Fuel Economy (ASTM D7589) engine test. The lubricating oils of this disclosure provide improved or maintained deposit control and cleanliness performance. This benefit is demonstrated for the lubricating oils of this disclosure in the Sequence IIIG engine tests (ASTM D7320).

Examples of techniques that can be employed to characterize the compositions formed by the process described above include, but are not limited to, analytical gas chromatography, nuclear magnetic resonance, thermogravimetric analysis (TGA), inductively coupled plasma mass spectrometry, differential scanning calorimetry (DSC), volatility and viscosity measurements.

Lubricating Oil Base Stocks

A wide range of lubricating oils is known in the art. Lubricating oils that are useful in the present disclosure are both natural oils and synthetic oils. Natural and synthetic oils (or mixtures thereof) can be used unrefined, refined, or rerefined (the latter is also known as reclaimed or reprocessed oil). Unrefined oils are those obtained directly from a natural or synthetic source and used without added purification. These include shale oil obtained directly from retorting operations, petroleum oil obtained directly from primary distillation, and ester oil obtained directly from an esterification process. Refined oils are similar to the oils discussed for unrefined oils except refined oils are subjected to one or more purification steps to improve the at least one lubricating oil property. One skilled in the art is familiar with many purification processes. These processes include solvent extraction, secondary distillation, acid extraction, base extraction, filtration, and percolation. Rerefined oils are obtained by processes analogous to refined oils but using an oil that has been previously used as a feed stock.

Groups I, II, III, IV and V are broad categories of base oil stocks developed and defined by the American Petroleum Institute (API Publication 1509; www.API.org) to create guidelines for lubricant base oils. Group I base stocks generally have a viscosity index of between about 80 to 120 and contain greater than about 0.03% sulfur and less than about 90% saturates. Group II base stocks generally have a viscosity index of between about 80 to 120, and contain less than or equal to about 0.03% sulfur and greater than or equal to about 90% saturates. Group III stock generally has a viscosity index greater than about 120 and contains less than or equal to about 0.03% sulfur and greater than about 90% saturates. Group IV includes polyalphaolefins (PAO). Group V base stocks include base stocks not included in Groups I-IV. Table 1 below summarizes properties of each of these five groups.

TABLE 1

Definition of API Base Oil Groups I, II, III, and IV

| | Base Oil Properties | | |
|---|---|---|---|
| | Saturates | Sulfur | Viscosity Index |
| Group I | <90 and/or | >0.03% and | ≥80 and <120 |
| Group II | ≥90 and | ≤0.03% and | ≥80 and <120 |
| Group III | ≥90 and | ≤0.03% and | ≥120 |
| Group IV | Includes polyalphaolefins (PAO) products | | |
| Group V | All other base oil stocks not included in Groups I, II, III or IV | | |

Natural oils include animal oils, vegetable oils (castor oil and lard oil, for example), and mineral oils. Animal and vegetable oils possessing favorable thermal oxidative stability can be used. Of the natural oils, mineral oils are preferred. Mineral oils vary widely as to their crude source, for example, as to whether they are paraffinic, naphthenic, or mixed paraffinic-naphthenic. Oils derived from coal or shale are also useful in the present disclosure. Natural oils vary also as to the method used for their production and purification, for example, their distillation range and whether they are straight run or cracked, hydrorefined, or solvent extracted.

Group II and/or Group III hydroprocessed or hydrocracked base stocks, as well as synthetic oils such as polyalphaolefins, alkyl aromatics and synthetic esters, i.e. Group IV and Group V oils are also well known base stock oils.

Synthetic oils include hydrocarbon oil. Hydrocarbon oils include oils such as polymerized and interpolymerized olefins (polybutylenes, polypropylenes, propylene isobutylene copolymers, ethylene-olefin copolymers, and ethylene-alphaolefin copolymers, for example). Polyalphaolefin (PAO) oil base stocks are commonly used synthetic hydrocarbon oil. By way of example, PAOs derived from C8, C10, C12, C14 olefins or mixtures thereof may be utilized. See U.S. Pat. Nos. 4,956,122; 4,827,064; and 4,827,073.

The number average molecular weights of the PAOs, which are known materials and generally available on a major commercial scale from suppliers such as ExxonMobil Chemical Company, Chevron Phillips Chemical Company, BP, and others, typically vary from about 250 to about 3,000, although PAO's may be made in viscosities up to about 150 cSt (100° C.). The PAOs are typically comprised of relatively low molecular weight hydrogenated polymers or oligomers of alphaolefins which include, but are not limited to, C2 to about C32 alphaolefins with the C8 to about C16 alphaolefins, such as 1-octene, 1-decene, 1-dodecene and the like, being preferred. The preferred polyalphaolefins are poly-1-octene, poly-1-decene and poly-1-dodecene and mixtures thereof and mixed olefin-derived polyolefins. However, the dimers of higher olefins in the range of C12 to C18 may be used to provide low viscosity base stocks of acceptably low volatility. Depending on the viscosity grade and the starting oligomer, the PAOs may be predominantly dimers, trimers and tetramers of the starting olefins, with minor amounts of the lower and/or higher oligomers, having a viscosity range of 1.5 cSt to 12 cSt. PAO fluids of particular use may include 3 cSt, 3.4 cSt, and/or 3.6 cSt and combinations thereof. Mixtures of PAO fluids having a viscosity range of 1.5 cSt to approximately 150 cSt or more may be used if desired. Unless indicated otherwise, all viscosities cited herein are measured at 100° C.

The PAO fluids may be conveniently made by the polymerization of an alphaolefin in the presence of a polymerization catalyst such as the Friedel-Crafts catalysts including, for example, aluminum trichloride, boron trifluoride or complexes of boron trifluoride with water, alcohols such as ethanol, propanol or butanol, carboxylic acids or esters such as ethyl acetate or ethyl propionate. For example the methods disclosed by U.S. Pat. No. 4,149,178 or 3,382,291 may be conveniently used herein. Other descriptions of PAO synthesis are found in the following U.S. Pat. Nos. 3,742,082; 3,769,363; 3,876,720; 4,239,930; 4,367,352; 4,413,156; 4,434,408; 4,910,355; 4,956,122; and 5,068,487. The dimers of the C14 to C18 olefins are described in U.S. Pat. No. 4,218,330.

Other useful lubricant oil base stocks include wax isomerate base stocks and base oils, comprising hydroisomerized waxy stocks (e.g. waxy stocks such as gas oils, slack waxes, fuels hydrocracker bottoms, etc.), hydroisomerized Fischer-Tropsch waxes, Gas-to-Liquids (GTL) base stocks and base oils, and other wax isomerate hydroisomerized base stocks and base oils, or mixtures thereof. Fischer-Tropsch waxes, the high boiling point residues of Fischer-Tropsch synthesis, are highly paraffinic hydrocarbons with very low sulfur content. The hydroprocessing used for the production of such base stocks may use an amorphous hydrocracking/hydroisomerization catalyst, such as one of the specialized lube hydrocracking (LHDC) catalysts or a crystalline hydrocracking/hydroisomerization catalyst, preferably a zeolitic catalyst. For example, one useful catalyst is ZSM-48 as described in U.S. Pat. No. 5,075,269, the disclosure of which is incorporated herein by reference in its entirety. Processes for making hydrocracked/hydroisomerized distillates and hydrocracked/hydroisomerized waxes are described, for example, in U.S. Pat. Nos. 2,817,693; 4,975,177; 4,921,594 and 4,897,178 as well as in British Patent Nos. 1,429,494; 1,350,257; 1,440,230 and 1,390,359. Each of the aforementioned patents is incorporated herein in their entirety. Particularly favorable processes are described in European Patent Application Nos. 464546 and 464547, also incorporated herein by reference. Processes using Fischer-Tropsch wax feeds are described in U.S. Pat. Nos. 4,594,172 and 4,943,672, the disclosures of which are incorporated herein by reference in their entirety.

Gas-to-Liquids (GTL) base oils, Fischer-Tropsch wax derived base oils, and other wax-derived hydroisomerized (wax isomerate) base oils be advantageously used in the instant disclosure, and may have useful kinematic viscosities at 100° C. of about 2 cSt to about 50 cSt, preferably about 2 cSt to about 30 cSt, more preferably about 3 cSt to about 25 cSt, as exemplified by GTL 4 with kinematic viscosity of about 4.0 cSt at 100° C. and a viscosity index of about 141. These Gas-to-Liquids (GTL) base oils, Fischer-Tropsch wax derived base oils, and other wax-derived hydroisomerized base oils may have useful pour points of about −20° C. or lower, and under some conditions may have advantageous pour points of about −25° C. or lower, with useful pour points of about −30° C. to about −40° C. or lower. Useful compositions of Gas-to-Liquids (GTL) base oils, Fischer-Tropsch wax derived base oils, and wax-derived hydroisomerized base oils are recited in U.S. Pat. Nos. 6,080,301; 6,090,989, and 6,165,949 for example, and are incorporated herein in their entirety by reference.

The hydrocarbyl aromatics can be used as a base oil or base oil component and can be any hydrocarbyl molecule that contains at least about 5% of its weight derived from an aromatic moiety such as a benzenoid moiety or naphthenoid moiety, or their derivatives. These hydrocarbyl aromatics include alkyl benzenes, alkyl naphthalenes, alkyl biphenyls, alkyl diphenyl oxides, alkyl naphthols, alkyl diphenyl sulfides, alkylated bis-phenol A, alkylated thiodiphenol, and the like. The aromatic can be mono-alkylated, dialkylated, polyalkylated, and the like. The aromatic can be mono- or poly-functionalized. The hydrocarbyl groups can also be comprised of mixtures of alkyl groups, alkenyl groups, alkynyl, cycloalkyl groups, cycloalkenyl groups and other related hydrocarbyl groups. The hydrocarbyl groups can range from about C6 up to about C60 with a range of about C8 to about C20 often being preferred. A mixture of hydrocarbyl groups is often preferred, and up to about three such substituents may be present. The hydrocarbyl group can optionally contain sulfur, oxygen, and/or nitrogen containing substituents. The aromatic group can also be derived from natural (petroleum) sources, provided at least about 5% of the molecule is comprised of an above-type aromatic moiety. Viscosities at 100° C. of approximately 2 cSt to about 50 cSt are preferred, with viscosities of approximately 3 cSt to about 20 cSt often being more preferred for the hydrocarbyl aromatic component. In one embodiment, an alkyl naphthalene where the alkyl group is primarily comprised of 1-hexadecene is used. Other alkylates of aromatics can be advantageously used. Naphthalene or methyl naphthalene, for example, can be alkylated with olefins such as octene, decene, dodecene, tetradecene or higher, mixtures of similar olefins, and the like. Alkylated naphthalene and analogues may also comprise compositions with isomeric distribution of alkylating groups on the alpha and beta carbon positions of the ring structure. Distribution of groups on the alpha and beta positions of a naphthalene ring may range from 100:1 to 1:100, more often 50:1 to 1:50 Useful concentrations of hydrocarbyl aromatic in a lubricant oil composition can be about 2% to about 25%, preferably about 4% to about 20%, and more preferably about 4% to about 15%, depending on the application.

Alkylated aromatics such as the hydrocarbyl aromatics of the present disclosure may be produced by well-known Friedel-Crafts alkylation of aromatic compounds. See Friedel-Crafts and Related Reactions, Olah, G. A. (ed.), Interscience Publishers, New York, 1963. For example, an aromatic compound, such as benzene or naphthalene, is alkylated by an olefin, alkyl halide or alcohol in the presence of a Friedel-Crafts catalyst. See Friedel-Crafts and Related Reactions, Vol. 2, part 1, chapters 14, 17, and 18, See Olah, G. A. (ed.), Inter-science Publishers, New York, 1964. Many homogeneous or heterogeneous, solid catalysts are known to one skilled in the art. The choice of catalyst depends on the reactivity of the starting materials and product quality requirements. For example, strong acids such as AlCl3, BF3, or HF may be used. In some cases, milder catalysts such as FeCl3 or SnCl4 are preferred. Newer alkylation technology uses zeolites or solid super acids.

Esters comprise a useful base stock. Additive solvency and seal compatibility characteristics may be secured by the use of esters such as the esters of dibasic acids with monoalkanols and the polyol esters of monocarboxylic acids. Esters of the former type include, for example, the esters of dicarboxylic acids such as phthalic acid, succinic acid, alkyl succinic acid, alkenyl succinic acid, maleic acid, azelaic acid, suberic acid, sebacic acid, fumaric acid, adipic acid, linoleic acid dimer, malonic acid, alkyl malonic acid, alkenyl malonic acid, etc., with a variety of alcohols such as butyl alcohol, hexyl alcohol, dodecyl alcohol, 2-ethylhexyl alcohol, etc. Specific examples of these types of esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, etc.

Particularly useful synthetic esters are those which are obtained by reacting one or more polyhydric alcohols, preferably the hindered polyols (such as the neopentyl polyols, e.g., neopentyl glycol, trimethylol ethane, 2-methyl-2-propyl-1,3-propanediol, trimethylol propane, pentaerythritol and dipentaerythritol) with alkanoic acids containing at least about 4 carbon atoms, preferably C5 to C30 acids such as saturated straight chain fatty acids including caprylic acid, capric acid, lauric acid, myristic acid, palmitic acid, stearic acid, arachic acid, and behenic acid, or the corresponding branched chain fatty acids or unsaturated fatty acids such as oleic acid, or mixtures of any of these materials.

Suitable synthetic ester components include the esters of trimethylol propane, trimethylol butane, trimethylol ethane, pentaerythritol and/or dipentaerythritol with one or more monocarboxylic acids containing from about 5 to about 10 carbon atoms. These esters are widely available commercially, for example, the Mobil P-41 and P-51 esters of ExxonMobil Chemical Company.

Also useful are esters derived from renewable material such as coconut, palm, rapeseed, soy, sunflower and the like. These esters may be monoesters, di-esters, polyol esters, complex esters, or mixtures thereof. These esters are widely available commercially, for example, the Mobil P-51 ester of ExxonMobil Chemical Company.

Engine oil formulations containing renewable esters are included in this disclosure. For such formulations, the renewable content of the ester is typically greater than about 70 weight percent, preferably more than about 80 weight percent and most preferably more than about 90 weight percent.

Other useful fluids of lubricating viscosity include non-conventional or unconventional base stocks that have been processed, preferably catalytically, or synthesized to provide high performance lubrication characteristics.

Non-conventional or unconventional base stocks/base oils include one or more of a mixture of base stock(s) derived from one or more Gas-to-Liquids (GTL) materials, as well as isomerate/isodewaxate base stock(s) derived from natural wax or waxy feeds, mineral and or non-mineral oil waxy feed stocks such as slack waxes, natural waxes, and waxy stocks such as gas oils, waxy fuels hydrocracker bottoms, waxy raffinate, hydrocrackate, thermal crackates, or other mineral, mineral oil, or even non-petroleum oil derived waxy materials such as waxy materials received from coal liquefaction or shale oil, and mixtures of such base stocks.

GTL materials are materials that are derived via one or more synthesis, combination, transformation, rearrangement, and/or degradation/deconstructive processes from gaseous carbon-containing compounds, hydrogen-containing compounds and/or elements as feed stocks such as hydrogen, carbon dioxide, carbon monoxide, water, methane, ethane, ethylene, acetylene, propane, propylene, propyne, butane, butylenes, and butynes. GTL base stocks and/or base oils are GTL materials of lubricating viscosity that are generally derived from hydrocarbons; for example, waxy synthesized hydrocarbons, that are themselves derived from simpler gaseous carbon-containing compounds, hydrogen-containing compounds and/or elements as feed stocks. GTL base stock(s) and/or base oil(s) include oils boiling in the lube oil boiling range (1) separated/fractionated from synthesized GTL materials such as, for example, by distillation and subsequently subjected to a final wax processing step which involves either or both of a catalytic dewaxing process, or a solvent dewaxing process, to produce lube oils of reduced/low pour point; (2) synthesized wax isomerates, comprising, for example, hydrodewaxed or hydroisomerized cat and/or solvent dewaxed synthesized wax or waxy hydrocarbons; (3) hydrodewaxed or hydroisomerized cat and/or solvent dewaxed Fischer-Tropsch (F-T) material (i.e., hydrocarbons, waxy hydrocarbons, waxes and possible analogous oxygenates); preferably hydrodewaxed or hydroisomerized/followed by cat and/or solvent dewaxing dewaxed F-T waxy hydrocarbons, or hydrodewaxed or hydroisomerized/followed by cat (or solvent) dewaxing dewaxed, F-T waxes, or mixtures thereof.

GTL base stock(s) and/or base oil(s) derived from GTL materials, especially, hydrodewaxed or hydroisomerized/followed by cat and/or solvent dewaxed wax or waxy feed, preferably F-T material derived base stock(s) and/or base oil(s), are characterized typically as having kinematic viscosities at 100° C. of from about 2 mm2/s to about 50 mm2/s (ASTM D445). They are further characterized typically as having pour points of −5° C. to about −40° C. or lower (ASTM D97). They are also characterized typically as having viscosity indices of about 80 to about 140 or greater (ASTM D2270).

In addition, the GTL base stock(s) and/or base oil(s) are typically highly paraffinic (>90% saturates), and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stock(s) and/or base oil(s) typically have very low sulfur and nitrogen content, generally containing less than about 10 ppm, and more typically less than about 5 ppm of each of these elements. The sulfur and nitrogen content of GTL base stock(s) and/or base oil(s) obtained from F-T material, especially F-T wax, is essentially nil. In addition, the absence of phosphorus and aromatics make this materially especially suitable for the formulation of low SAP products.

The term GTL base stock and/or base oil and/or wax isomerate base stock and/or base oil is to be understood as embracing individual fractions of such materials of wide viscosity range as recovered in the production process, mixtures of two or more of such fractions, as well as mixtures of one or two or more low viscosity fractions with one, two or more higher viscosity fractions to produce a blend wherein the blend exhibits a target kinematic viscosity.

The GTL material, from which the GTL base stock(s) and/or base oil(s) is/are derived is preferably an F-T material (i.e., hydrocarbons, waxy hydrocarbons, wax).

Base oils for use in the formulated lubricating oils useful in the present disclosure are any of the variety of oils corresponding to API Group I, Group II, Group III, Group IV, and Group V oils and mixtures thereof, preferably API Group II, Group III, Group IV, and Group V oils and mixtures thereof, more preferably the Group III to Group V base oils due to their exceptional volatility, stability, viscometric and cleanliness features. Minor quantities of Group I stock, such as the amount used to dilute additives for blending into formulated lube oil products, can be tolerated but should be kept to a minimum, i.e. amounts only associated with their use as diluent/carrier oil for additives used on an "as-received" basis. Even in regard to the Group II stocks, it is preferred that the Group II stock be in the higher quality range associated with that stock, i.e. a Group II stock having a viscosity index in the range 100<VI<120.

The base stock component of the present lubricating oils will typically be from 1 to 99 weight percent of the total composition (all proportions and percentages set out in this specification are by weight unless the contrary is stated) and more preferably in the range of 10 to 99 weight percent, or more preferably from 15 to 80 percent, or more preferably from 20 to 70 percent, or more preferably from 25 to 60 percent, or more preferably from 30 to 50 percent.

Cobase Stock Components

Illustrative cobase stocks useful in the lubricating oils of this disclosure include, for example, a Group IV cobase stock, a Group V cobase stock, or mixtures thereof.

Preferred cobase stocks useful in the lubricating oils of this disclosure include, for example, C20-36 polyalphaolefins, C24-32 polyalphaolefins, C24-28 polyalphaolefins, or mixtures thereof, and having from about 1 to about 4 branch points.

Other preferred cobase stocks useful in the lubricating oils of this disclosure include, for example, polyalphaolefins derived from C8, C10, C12, C14 olefins, or mixtures thereof, and having from about 1 to about 4 branch points.

A more preferred cobase stock useful in the lubricating oils of this disclosure includes, for example, a dimerized, hydrogenated C14 linear alphaolefin having a kinematic viscosity (Kv100) less than about 4 cSt at 100° C. as determined by ASTM D445.

The cobase stocks useful in the lubricating oils of this disclosure have a kinematic viscosity (Kv100) less than about 6.2 cSt, or less than 6.0, or less than 5.5, preferably a kinematic viscosity (Kv100) from about 1 cSt to about 5 cSt, more preferably from about 2 cSt to about 4 cSt, at 100° C. as determined by ASTM D445.

Polyalphaolefin (PAO) cobase stocks are preferred cobase stocks for use in the present disclosure. Polyalphaolefin (PAO) base stocks may also be used in the present disclosure. PAOs in general are typically comprised of relatively low molecular weight hydrogenated polymers or oligomers of polyalphaolefins which include, but are not limited to, C2 to about C36 alphaolefins, with the C8 to about C16 alphaolefins, such as 1-octene, 1-decene, 1-dodecene, 1-tetradecene and the like, being preferred. The preferred polyalphaolefins are poly-1-octene, poly-1-decene, poly-1-dodecene, poly-1-tetradecene, and mixtures thereof and mixed olefin-derived polyolefins.

The PAO fluids may be conveniently made by the polymerization of one or a mixture of alphaolefins in the presence of a polymerization catalyst such as the Friedel-Crafts catalyst including, for example, aluminum trichloride, boron trifluoride or complexes of boron trifluoride with water, alcohols such as ethanol, propanol or butanol, carboxylic acids or esters such as ethyl acetate or ethyl proprionate. For example, the methods disclosed by U.S. Pat. No. 4,149,178 or U.S. Pat. No. 3,382,291 may be conveniently used herein. Other descriptions of PAO synthesis are found in the following U.S. Pat. Nos. 3,742,082; 3,769,363; 3,876,720; 4,239,930; 4,367,352; 4,413,156; 4,434,408; 4,910,355; 4,956,122; and 5,068,487. The dimers of the C14 to C18 olefins are described in U.S. Pat. No. 4,218,330. PAOs useful in the present disclosure may have a kinematic viscosity at 100° C. from about 1 to about 4 cSt as determined by ASTM D445. For the purposes of this disclosure the PAO preferably has a kinematic viscosity (Kv100) less than about 4 cSt, preferably a kinematic viscosity (Kv100) from about 1 cSt to about 4 cSt, more preferably from about 2 cSt to about 4 cSt, at 100° C. as determined by ASTM D445. PAOs are often identified by reference to their approximate kinematic viscosity at 100° C. For example, PAO 4 refers to a PAO with a kinematic viscosity of approximately 4 cSt at 100° C.

The PAOs useful in the present disclosure can also be made by metallocene catalysis. The metallocene-catalyzed PAO (mPAO) can be a copolymer made from at least two or more different alphaolefins, or a homo-polymer made from a single alphaolefin feed employing a metallocene catalyst system.

Illustrative polyalphaolefin oligomers useful in preparing the PAO cobase stocks of this disclosure include, for example, mPAO dimers, trimers, tetramers, higher oligomers, and the like.

In an embodiment, the mPAO dimer can be any dimer prepared from metallocene or other single-site catalyst with terminal double bond. The dimer can be from 1-decene, 1-octene, 1-dodecene, 1-hexene, 1-tetradecene, 1-octadecene or combination of alpha-olefins.

The metallocene-derived product is produced by the oligomerization of an alpha-olefin feed using a metallocene oligomerization catalyst. The alphaolefin feeds used in this initial oligomerization step are typically alpha-olefin monomers of 4 to 24 carbon atoms, usually 6 to 20 and preferably 8 to 14 carbon atoms. Illustrative alphaolefin feeds include, for example, 1-butene, 1-hexene, 1-octene, 1-decene, 1-dodecene, 1-tetradecene, and the like. The olefins with even carbon numbers are preferred as are the linear alpha-olefins, although it is possible to use branched-chain olefins containing an alkyl substituent at least two carbons away from the terminal double bond.

The oligomerization step using a metallocene catalyst can be carried out under the conditions appropriate to the selected alpha-olefin feed and metallocene catalyst. A preferred metallocene-catalyzed alpha-olefin oligomerization process is described in WO 2007/011973, which is incorporated herein by reference in its entirety and to which reference is made for details of feeds, metallocene catalysts, process conditions and characterizations of products.

The dimers useful as feeds in the process of this disclosure possess at least one carbon-carbon unsaturated double bond. The unsaturation is normally more or less centrally located at the junction of the two monomer units making up the dimer as a result of the non-isomerizing polymerization mechanism characteristic of metallocene processes. If the initial metallocene polymerization step uses a single 1-olefin feed to make an alpha-olefin homopolymer, the unsaturation will be centrally located but if two 1-olefin comonomers have been used to form a metallocene copolymer, the location of the double bond may be shifted off center in accordance with the chain lengths of the two comonomers used. In any event, this double bond is 1,2-substituted internal, vinylic or vinylidenic in character. The terminal vinylidene group is represented by the formula RaRbC═CH2, referred to as vinyl when the formula is RaHC═CH2. The amount of unsaturation can be quantitatively measured by bromine number measurement according to ASTM D1159 or equivalent method, or according to proton or carbon-13 NMR. Proton NMR spectroscopic analysis can also differentiate and quantify the types of olefinic unsaturation.

Illustrative olefins that can be used include, for example, α-olefins, internal olefins, unhydrogenated poly-α-olefins, unhydrogenated ethylene α-olefin copolymers, unhydrogenated polyisobutylene, olefins with terminal double bond containing macromers, and the like.

The metallocene catalyst can be simple metallocenes, substituted metallocenes or bridged metallocene catalysts activated or promoted by, for instance, methylaluminoxane (MAO) or a non-coordinating anion, such as N,N-dimethylanilinium tetrakis(perfluorophenyl)borate or other equivalent non-coordinating anion. mPAO and methods for producing mPAO employing metallocene catalysis are described in WO 2007/011832 and U.S. Publication No. 2009/0036725.

The copolymer mPAO composition is made from at least two alphaolefins of C20 to C36 range, preferably C24 to C32 range, more preferably C24 to C28 range, and having monomers randomly distributed in the polymers. It is preferred that the average carbon number is at least 4.1. Advantageously, ethylene and propylene, if present in the feed, are present in the amount of less than 50 wt % individually or preferably less than 50 wt % combined. The copolymers can be isotactic, atactic, syndiotactic polymers or any other form of appropriate taciticity.

mPAO can also be made from mixed feed Linear Alphaolefins (LAOS) comprising at least two and up to 26 different linear alphaolefins selected from C20 to C36 range linear alphaolefins. The mixed feed LAO can be obtained, for example, from an ethylene growth processing using an aluminum catalyst or a metallocene catalyst. The growth olefins comprise mostly C24 to C32 range LAO. LAOs from other processes can also be used.

The homo-polymer mPAO composition can be made from single alphaolefin chosen from alphaolefins in the C20 to C36 range, preferably C24 to C32 range, most preferably C24 to C28 range. The homo-polymers can be isotactic, atactic, syndiotactic polymers or any other form of appropriate taciticity. The taciticity can be carefully tailored by the polymerization catalyst and polymerization reaction condition chosen or by the hydrogenation condition chosen.

The alphaolefin(s) can be chosen also from any component from a conventional LAO production facility or from a refinery. It can be used alone to make homo-polymer or together with another LAO available from a refinery or chemical plant, including propylene, 1-butene, 1-pentene, and the like, or with 1-hexene or 1-octene made from a dedicated production facility. The alphaolefins also can be chosen from the alphaolefins produced from Fischer-Tropsch synthesis (as reported in U.S. Pat. No. 5,382,739). For example, C24 to C28 alphaolefins, more preferably linear alphaolefins, are suitable to make homo-polymers. Other combinations, such as C4- and C14-LAO, C6- and C16-LAO, C8-, C10-, C12-LAO, or C8- and C14-LAO, C6-, C10-, C14-LAO, C4- and C12-LAO, etc., are suitable to make copolymers.

A feed comprising a mixture of LAOs selected from C3 to C16 LAOs or a single LAO selected from C8 to C14 LAO, is contacted with an activated metallocene catalyst under oligomerization conditions to provide a liquid product suitable for use in lubricant components or as functional fluids. Also embraced are copolymer compositions made from at least two alphaolefins of C8 to C14 range and having monomers randomly distributed in the polymers. The phrase "at least two alphaolefins" will be understood to mean "at least two different alphaolefins" (and similarly "at least three alphaolefins" means "at least three different alphaolefins", and so forth).

The product obtained is an essentially random liquid copolymer comprising the at least two alphaolefins. By "essentially random" is meant that one of ordinary skill in the art would consider the products to be random copolymer. Likewise the term "liquid" will be understood by one of ordinary skill in the art as meaning liquid under ordinary conditions of temperature and pressure, such as ambient temperature and pressure.

The polyalphaolefins preferably have a Bromine number of 1.8 or less as measured by ASTM D1159, preferably 1.7 or less, preferably 1.6 or less, preferably 1.5 or less, preferably 1.4 or less, preferably 1.3 or less, preferably 1.2 or less, preferably 1.1 or less, preferably 1.0 or less, preferably 0.5 or less, preferably 0.1 or less. If necessary the polyalphaolefins can be hydrogenated to achieve a low bromine number.

Any of the mpolyalphaolefins (mPAO) described herein may have an Mw (weight average molecular weight) of 100,000 or less, preferably between 100 and 80,000, preferably between 250 and 60,000, preferably between 280 and 50,000, preferably between 336 and 40,000 g/mol.

Any of the mpolyalphaolefins (mPAO) described herein may have a Mn (number average molecular weight) of 50,000 or less, preferably between 200 and 40,000, preferably between 250 and 30,000, preferably between 500 and 20,000 g/mol.

Any of the m-polyalphaolefins (mPAO) described herein may have a molecular weight distribution (MWD-Mw/Mn) of greater than 1 and less than 5, preferably less than 4, preferably less than 3, preferably less than 2.5. The MWD of mPAO is always a function of fluid viscosity. Alternately, any of the polyalphaolefins described herein may have an Mw/Mn of between 1 and 2.5, alternately between 1 and 3.5, depending on fluid viscosity.

Molecular weight distribution (MWD), defined as the ratio of weight-averaged MW to number-averaged MW (=Mw/Mn), can be determined by gel permeation chromatography (GPC) using polystyrene standards, as described in p. 115 to 144, Chapter 6, The Molecular Weight of Polymers in "Principles of Polymer Systems" (by Ferdinand Rodrigues, McGraw-Hill Book, 1970). The GPC solvent was HPLC Grade tetrahydrofuran, uninhibited, with a column temperature of 30° C., a flow rate of 1 ml/min, and a sample concentration of 1 wt %, and the Column Set is a Phenogel 500 A, Linear, 10E6A.

Any of the m-polyalphaolefins (mPAO) described herein may have a substantially minor portion of a high end tail of the molecular weight distribution. Preferably, the mPAO has not more than 5.0 wt % of polymer having a molecular weight of greater than 45,000 Daltons. Additionally or alternately, the amount of the mPAO that has a molecular weight greater than 45,000 Daltons is not more than 1.5 wt %, or not more than 0.10 wt %. Additionally or alternately, the amount of the mPAO that has a molecular weight greater than 60,000 Daltons is not more than 0.5 wt %, or not more than 0.20 wt %, or not more than 0.1 wt %. The mass fractions at molecular weights of 45,000 and 60,000 can be determined by GPC, as described above.

Any mPAO described herein may have a pour point of less than 0° C. (as measured by ASTM D97), preferably less than −10° C., preferably less than −20° C., preferably less than −25° C., preferably less than −30° C., preferably less than −35° C., preferably less than −50° C., preferably from −10° C. to −80° C., preferably from −15° C. to −70° C.

mPolyalphaolefins (mPAO) made using metallocene catalysis may have a kinematic viscosity at 100° C. from about 1 to about 4 cSt. For the purposes of this disclosure the mPAO preferably has a kinematic viscosity at 100° C. of less than about 4 cSt, preferably a kinematic viscosity (Kv100) from about 1 cSt to about 4 cSt, more preferably from about 2 cSt to about 4 cSt, at 100° C. as determined by ASTM D445.

The cobase stock component is preferably present in an amount sufficient to reduce kinematic viscosity ($Kv_{100}$) of the base oil mixture used to formulate the lubricating oil as determined by ASTM D445, while maintaining or controlling cold cranking simulator viscosity (CCSV) of the lubricating oil as determined by ASTM D5293-15, such that the lubricating oil meets both kinematic viscosity ($Kv_{100}$) and cold cranking simulator viscosity (CCSV) requirements for a SAE engine oil grade as determined by SAE J300 viscosity grade classification system. The cobase stock component can be present as the major base stock in the lubricating oils of this disclosure. Accordingly, the cobase stock component can be present in an amount from about 1 to about 99 weight percent, and preferably from about 5 to about 99 weight percent, and more preferably from about 10 to about 99 weight percent, or more preferably from about 40 to about 90 weight percent, or more preferably from about 50 to about 80 weight percent, or more preferably from about 60 to about 80 weight percent.

The cobase stock is preferably present as a minor component in the lubricating oils of this disclosure. Accordingly, the cobase stock component of the present lubricating oils will typically be present from 1 to 50 weight percent, or more preferably from 2 to 20 weight percent, or more preferably from 2 to 15 weight percent, or more preferably from 3 to 10 weight percent.

Lubricating Oil Additives

The formulated lubricating oil useful in the present disclosure may additionally contain one or more of the commonly used lubricating oil performance additives including but not limited to dispersants, detergents, corrosion inhibitors, rust inhibitors, metal deactivators, antiwear agents and/or extreme pressure additives, anti-seizure agents, wax modifiers, viscosity index improvers, viscosity modifiers, fluid-loss additives, seal compatibility agents, other friction modifiers, lubricity agents, anti-staining agents, chromophoric agents, defoamants, demulsifiers, emulsifiers, densifiers, wetting agents, gelling agents, tackiness agents, colorants, and others. For a review of many commonly used additives, see Klamann in Lubricants and Related Products, Verlag Chemie, Deerfield Beach, Fla.; ISBN 0-89573-177-0. Reference is also made to "Lubricant Additives" by M. W. Ranney, published by Noyes Data Corporation of Parkridge, N J (1973); see also U.S. Pat. No. 7,704,930, the disclosure of which is incorporated herein in its entirety. These additives are commonly delivered with varying amounts of diluent oil, that may range from 5 weight percent to 50 weight percent.

All of the additives described below can be used alone or in combination. The total treat rates for the additives can range from 1 to 30 percent, or more preferably from 2 to 25 percent, or more preferably from 3 to 20 percent, or more preferably from 4 to 15 percent, or more preferably from 5 to 10 percent. Particularly preferred compositions have additive levels between 15 and 20 percent.

The additives useful in this disclosure do not have to be soluble in the lubricating oils. Insoluble additives in oil can be dispersed in the lubricating oils of this disclosure.

The types and quantities of performance additives used in combination with the instant disclosure in lubricant compositions are not limited by the examples shown herein as illustrations.

Dispersants

During engine operation, oil-insoluble oxidation byproducts are produced. Dispersants help keep these byproducts in solution, thus diminishing their deposition on metal surfaces.

Dispersants used in the formulation of the lubricating oil may be ashless or ash-forming in nature. Preferably, the dispersant is ashless. So called ashless dispersants are organic materials that form substantially no ash upon combustion. For example, non-metal-containing or borated metal-free dispersants are considered ashless. In contrast, metal-containing detergents discussed above form ash upon combustion.

Suitable dispersants typically contain a polar group attached to a relatively high molecular weight hydrocarbon chain. The polar group typically contains at least one element of nitrogen, oxygen, or phosphorus. Typical hydrocarbon chains contain 50 to 400 carbon atoms.

A particularly useful class of dispersants are the (poly) alkenylsuccinic derivatives, typically produced by the reaction of a long chain hydrocarbyl substituted succinic compound, usually a hydrocarbyl substituted succinic anhydride, with a polyhydroxy or polyamino compound. The long chain hydrocarbyl group constituting the oleophilic portion of the molecule which confers solubility in the oil, is normally a polyisobutylene group. Many examples of this type of dispersant are well known commercially and in the literature. Exemplary U.S. patents describing such dispersants are U.S. Pat. Nos. 3,172,892; 3,2145,707; 3,219,666; 3,316,177; 3,341,542; 3,444,170; 3,454,607; 3,541,012; 3,630,904; 3,632,511; 3,787,374 and 4,234,435. Other types of dispersant are described in U.S. Pat. Nos. 3,036,003; 3,200,107; 3,254,025; 3,275,554; 3,438,757; 3,454,555; 3,565,804; 3,413,347; 3,697,574; 3,725,277; 3,725,480; 3,726,882; 4,454,059; 3,329,658; 3,449,250; 3,519,565; 3,666,730; 3,687,849; 3,702,300; 4,100,082; 5,705,458. A further description of dispersants may be found, for example, in European Patent Application No. 471 071, to which reference is made for this purpose.

Hydrocarbyl-substituted succinic acid and hydrocarbyl-substituted succinic anhydride derivatives are useful dispersants. In particular, succinimide, succinate esters, or succinate ester amides prepared by the reaction of a hydrocarbon-substituted succinic acid compound preferably having at least 50 carbon atoms in the hydrocarbon substituent, with at least one equivalent of an alkylene amine are particularly useful.

Succinimides are formed by the condensation reaction between hydrocarbyl substituted succinic anhydrides and amines. Molar ratios can vary depending on the polyamine. For example, the molar ratio of hydrocarbyl substituted succinic anhydride to TEPA can vary from about 1:1 to about 5:1. Representative examples are shown in U.S. Pat. Nos. 3,087,936; 3,172,892; 3,219,666; 3,272,746; 3,322,670; and U.S. Pat. Nos. 3,652,616, 3,948,800; and Canada Patent No. 1,094,044.

Succinate esters are formed by the condensation reaction between hydrocarbyl substituted succinic anhydrides and alcohols or polyols. Molar ratios can vary depending on the alcohol or polyol used. For example, the condensation product of a hydrocarbyl substituted succinic anhydride and pentaerythritol is a useful dispersant.

Succinate ester amides are formed by condensation reaction between hydrocarbyl substituted succinic anhydrides and alkanol amines. For example, suitable alkanol amines include ethoxylated polyalkylpolyamines, propoxylated polyalkylpolyamines and polyalkenylpolyamines such as polyethylene polyamines. One example is propoxylated hexamethylenediamine. Representative examples are shown in U.S. Pat. No. 4,426,305.

The molecular weight of the hydrocarbyl substituted succinic anhydrides used in the preceding paragraphs will typically range between 800 and 2,500 or more. The above products can be post-reacted with various reagents such as sulfur, oxygen, formaldehyde, carboxylic acids such as oleic acid. The above products can also be post reacted with boron compounds such as boric acid, borate esters or highly borated dispersants, to form borated dispersants generally having from about 0.1 to about 5 moles of boron per mole of dispersant reaction product.

Mannich base dispersants are made from the reaction of alkylphenols, formaldehyde, and amines. See U.S. Pat. No. 4,767,551, which is incorporated herein by reference. Process aids and catalysts, such as oleic acid and sulfonic acids, can also be part of the reaction mixture. Molecular weights of the alkylphenols range from 800 to 2,500. Representative examples are shown in U.S. Pat. Nos. 3,697,574; 3,703,536; 3,704,308; 3,751,365; 3,756,953; 3,798,165; and 3,803,039.

Typical high molecular weight aliphatic acid modified Mannich condensation products useful in this disclosure can be prepared from high molecular weight alkyl-substituted hydroxyaromatics or $HNR_2$ group-containing reactants.

Hydrocarbyl substituted amine ashless dispersant additives are well known to one skilled in the art; see, for example, U.S. Pat. Nos. 3,275,554; 3,438,757; 3,565,804; 3,755,433, 3,822,209, and 5,084,197.

Preferred dispersants include borated and non-borated succinimides, including those derivatives from mono-succinimides, bis-succinimides, and/or mixtures of mono- and bis-succinimides, wherein the hydrocarbyl succinimide is derived from a hydrocarbylene group such as polyisobutylene having a Mn of from about 500 to about 5000, or from about 1000 to about 3000, or about 1000 to about 2000, or a mixture of such hydrocarbylene groups, often with high terminal vinylic groups. Other preferred dispersants include succinic acid-esters and amides, alkylphenol-polyamine-coupled Mannich adducts, their capped derivatives, and other related components.

Polymethacrylate or polyacrylate derivatives are another class of dispersants. These dispersants are typically prepared by reacting a nitrogen containing monomer and a methacrylic or acrylic acid esters containing 5-25 carbon atoms in the ester group. Representative examples are shown in U.S. Pat. Nos. 2,100,993, and 6,323,164. Polymethacrylate and polyacrylate dispersants are normally used as multifunctional viscosity modifiers. The lower molecular weight versions can be used as lubricant dispersants or fuel detergents.

Illustrative preferred dispersants useful in this disclosure include those derived from polyalkenyl-substituted mono- or dicarboxylic acid, anhydride or ester, which dispersant has a polyalkenyl moiety with a number average molecular weight of at least 900 and from greater than 1.3 to 1.7, preferably from greater than 1.3 to 1.6, most preferably from greater than 1.3 to 1.5, functional groups (mono- or dicarboxylic acid producing moieties) per polyalkenyl moiety (a medium functionality dispersant). Functionality (F) can be determined according to the following formula:

$$F=(\mathrm{SAP}\times M_n)/((112{,}200\times \mathrm{A.I.})-(\mathrm{SAP}\times 98))$$

wherein SAP is the saponification number (i.e., the number of milligrams of KOH consumed in the complete neutralization of the acid groups in one gram of the succinic-containing reaction product, as determined according to ASTM D94); $M_n$ is the number average molecular weight of the starting olefin polymer; and A.I. is the percent active ingredient of the succinic-containing reaction product (the remainder being unreacted olefin polymer, succinic anhydride and diluent).

The polyalkenyl moiety of the dispersant may have a number average molecular weight of at least 900, suitably at least 1500, preferably between 1800 and 3000, such as between 2000 and 2800, more preferably from about 2100 to 2500, and most preferably from about 2200 to about 2400. The molecular weight of a dispersant is generally expressed in terms of the molecular weight of the polyalkenyl moiety. This is because the precise molecular weight range of the dispersant depends on numerous parameters including the type of polymer used to derive the dispersant, the number of functional groups, and the type of nucleophilic group employed.

Polymer molecular weight, specifically $M_n$, can be determined by various known techniques. One convenient method is gel permeation chromatography (GPC), which additionally provides molecular weight distribution information (see W. W. Yau, J. J. Kirkland and D. D. Bly, "Modern Size Exclusion Liquid Chromatography", John Wiley and Sons, New York, 1979). Another useful method for determining molecular weight, particularly for lower molecular weight polymers, is vapor pressure osmometry (e.g., ASTM D3592).

The polyalkenyl moiety in a dispersant preferably has a narrow molecular weight distribution (MWD), also referred to as polydispersity, as determined by the ratio of weight average molecular weight ($M_w$) to number average molecular weight ($M_n$). Polymers having a $M_w/M_n$ of less than 2.2, preferably less than 2.0, are most desirable. Suitable polymers have a polydispersity of from about 1.5 to 2.1, preferably from about 1.6 to about 1.8.

Suitable polyalkenes employed in the formation of the dispersants include homopolymers, interpolymers or lower molecular weight hydrocarbons. One family of such polymers comprise polymers of ethylene and/or at least one $C_3$ to $C_2$ alpha-olefin having the formula $H_2C{=}CHR^1$ wherein $R_1$ is a straight or branched chain alkyl radical comprising 1 to 26 carbon atoms and wherein the polymer contains carbon-to-carbon unsaturation, and a high degree of terminal ethenylidene unsaturation. Preferably, such polymers comprise interpolymers of ethylene and at least one alpha-olefin of the above formula, wherein $R^1$ is alkyl of from 1 to 18 carbon atoms, and more preferably is alkyl of from 1 to 8 carbon atoms, and more preferably still of from 1 to 2 carbon atoms.

Another useful class of polymers is polymers prepared by cationic polymerization of monomers such as isobutene and styrene. Common polymers from this class include polyisobutenes obtained by polymerization of a $C_4$ refinery stream having a butene content of 35 to 75% by wt., and an isobutene content of 30 to 60% by wt. A preferred source of monomer for making poly-n-butenes is petroleum feedstreams such as Raffinate II. These feedstocks are disclosed in the art such as in U.S. Pat. No. 4,952,739. A preferred embodiment utilizes polyisobutylene prepared from a pure isobutylene stream or a Raffinate I stream to prepare reactive isobutylene polymers with terminal vinylidene olefins. Polyisobutene polymers that may be employed are generally based on a polymer chain of from 1500 to 3000.

The dispersant(s) are preferably non-polymeric (e.g., mono- or bis-succinimides). Such dispersants can be prepared by conventional processes such as disclosed in U.S. Patent Application Publication No. 2008/0020950, the disclosure of which is incorporated herein by reference.

The dispersant(s) can be borated by conventional means, as generally disclosed in U.S. Pat. Nos. 3,087,936, 3,254,025 and 5,430,105.

Such dispersants may be used in an amount of about 0.01 to 20 weight percent or 0.01 to 10 weight percent, preferably about 0.5 to 8 weight percent, or more preferably 0.5 to 4 weight percent. Or such dispersants may be used in an amount of about 2 to 12 weight percent, preferably about 4 to 10 weight percent, or more preferably 6 to 9 weight percent. On an active ingredient basis, such additives may be used in an amount of about 0.06 to 14 weight percent, preferably about 0.3 to 6 weight percent. The hydrocarbon portion of the dispersant atoms can range from $C_{60}$ to $C_{1000}$, or from $C_{70}$ to $C_{300}$, or from $C_{70}$ to $C_{200}$. These dispersants may contain both neutral and basic nitrogen, and mixtures of both. Dispersants can be end-capped by borates and/or cyclic carbonates. Nitrogen content in the finished oil can vary from about 200 ppm by weight to about 2000 ppm by weight, preferably from about 200 ppm by weight to about 1200 ppm by weight. Basic nitrogen can vary from about 100 ppm by weight to about 1000 ppm by weight, preferably from about 100 ppm by weight to about 600 ppm by weight.

Dispersants as described herein are beneficially useful with the compositions of this disclosure and substitute for some or all of the surfactants of this disclosure. Further, in one embodiment, preparation of the compositions of this disclosure using one or more dispersants is achieved by combining ingredients of this disclosure, plus optional base stocks and lubricant additives, in a mixture at a temperature above the melting point of such ingredients, particularly that of the one or more M-carboxylates (M=H, metal, two or more metals, mixtures thereof).

As used herein, the dispersant concentrations are given on an "as delivered" basis. Typically, the active dispersant is delivered with a process oil. The "as delivered" dispersant typically contains from about 20 weight percent to about 80 weight percent, or from about 40 weight percent to about 60 weight percent, of active dispersant in the "as delivered" dispersant product.

Detergents

Illustrative detergents useful in this disclosure include, for example, alkali metal detergents, alkaline earth metal detergents, or mixtures of one or more alkali metal detergents and one or more alkaline earth metal detergents. A typical detergent is an anionic material that contains a long chain hydrophobic portion of the molecule and a smaller anionic or oleophobic hydrophilic portion of the molecule. The anionic portion of the detergent is typically derived from an organic acid such as a sulfur-containing acid, carboxylic acid (e.g., salicylic acid), phosphorus-containing acid, phenol, or mixtures thereof. The counterion is typically an alkaline earth or alkali metal. The detergent can be overbased as described herein.

The detergent is preferably a metal salt of an organic or inorganic acid, a metal salt of a phenol, or mixtures thereof. The metal is preferably selected from an alkali metal, an alkaline earth metal, and mixtures thereof. The organic or inorganic acid is selected from an aliphatic organic or inorganic acid, a cycloaliphatic organic or inorganic acid, an aromatic organic or inorganic acid, and mixtures thereof.

The metal is preferably selected from an alkali metal, an alkaline earth metal, and mixtures thereof. More preferably, the metal is selected from calcium (Ca), magnesium (Mg), and mixtures thereof.

The organic acid or inorganic acid is preferably selected from a sulfur-containing acid, a carboxylic acid, a phosphorus-containing acid, and mixtures thereof.

Preferably, the metal salt of an organic or inorganic acid or the metal salt of a phenol comprises calcium phenate, calcium sulfonate, calcium salicylate, magnesium phenate, magnesium sulfonate, magnesium salicylate, an overbased detergent, and mixtures thereof.

Salts that contain a substantially stochiometric amount of the metal are described as neutral salts and have a total base number (TBN, as measured by ASTM D2896) of from 0 to 80. Many compositions are overbased, containing large amounts of a metal base that is achieved by reacting an excess of a metal compound (a metal hydroxide or oxide, for example) with an acidic gas (such as carbon dioxide). Useful detergents can be neutral, mildly overbased, or highly overbased. These detergents can be used in mixtures of neutral, overbased, highly overbased calcium salicylate, sulfonates, phenates and/or magnesium salicylate, sulfonates, phenates. The TBN ranges can vary from low, medium to high TBN products, including as low as 0 to as high as 600. Preferably the TBN delivered by the detergent is between 1 and 20. More preferably between 1 and 12. Mixtures of low, medium, high TBN can be used, along with mixtures of calcium and magnesium metal based detergents, and including sulfonates, phenates, salicylates, and carboxylates. A detergent mixture with a metal ratio of 1, in conjunction of a detergent with a metal ratio of 2, and as high as a detergent with a metal ratio of 5, can be used. Borated detergents can also be used.

Alkaline earth phenates are another useful class of detergent. These detergents can be made by reacting alkaline earth metal hydroxide or oxide (CaO, $Ca(OH)_2$, BaO, $Ba(OH)_2$, MgO, $Mg(OH)_2$, for example) with an alkyl phenol or sulfurized alkylphenol. Useful alkyl groups include straight chain or branched $C_1$-$C_{30}$ alkyl groups, preferably, $C_4$-$C_{20}$ or mixtures thereof. Examples of suitable phenols include isobutylphenol, 2-ethylhexylphenol, nonylphenol, dodecyl phenol, and the like. It should be noted that starting alkylphenols may contain more than one alkyl substituent that are each independently straight chain or branched and can be used from 0.5 to 6 weight percent. When a non-sulfurized alkylphenol is used, the sulfurized product may be obtained by methods well known in the art. These methods include heating a mixture of alkylphenol and sulfurizing agent (including elemental sulfur, sulfur halides such as sulfur dichloride, and the like) and then reacting the sulfurized phenol with an alkaline earth metal base.

In accordance with this disclosure, metal salts of carboxylic acids are preferred detergents. These carboxylic acid detergents may be prepared by reacting a basic metal compound with at least one carboxylic acid and removing free water from the reaction product. These compounds may be overbased to produce the desired TBN level. Detergents made from salicylic acid are one preferred class of detergents derived from carboxylic acids. Useful salicylates include long chain alkyl salicylates. One useful family of compositions is of the formula

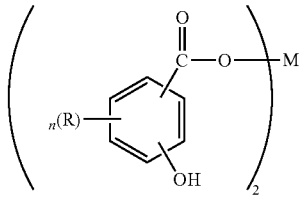

where R is an alkyl group having 1 to about 30 carbon atoms, n is an integer from 1 to 4, and M is an alkaline earth metal. Preferred R groups are alkyl chains of at least $C_{11}$, preferably $C_{13}$ or greater. R may be optionally substituted with substituents that do not interfere with the detergent's function. M is preferably, calcium, magnesium, barium, or mixtures thereof. More preferably, M is calcium.

Hydrocarbyl-substituted salicylic acids may be prepared from phenols by the Kolbe reaction (see U.S. Pat. No. 3,595,791). The metal salts of the hydrocarbyl-substituted salicylic acids may be prepared by double decomposition of a metal salt in a polar solvent such as water or alcohol.

Alkaline earth metal phosphates are also used as detergents and are known in the art.

Detergents may be simple detergents or what is known as hybrid or complex detergents. The latter detergents can provide the properties of two detergents without the need to blend separate materials. See U.S. Pat. No. 6,034,039.

Preferred detergents include calcium sulfonates, magnesium sulfonates, calcium salicylates, magnesium salicylates, calcium phenates, magnesium phenates, and other related components (including borated detergents), and mixtures thereof. Preferred mixtures of detergents include magnesium sulfonate and calcium salicylate, magnesium sulfonate and calcium sulfonate, magnesium sulfonate and calcium phenate, calcium phenate and calcium salicylate, calcium phenate and calcium sulfonate, calcium phenate and magnesium salicylate, calcium phenate and magnesium phenate. Overbased detergents are also preferred.

The detergent concentration in the lubricating oils of this disclosure can range from about 0.5 to about 6.0 weight percent, preferably about 0.6 to 5.0 weight percent, and more preferably from about 0.8 weight percent to about 4.0 weight percent, based on the total weight of the lubricating oil.

As used herein, the detergent concentrations are given on an "as delivered" basis. Typically, the active detergent is delivered with a process oil. The "as delivered" detergent typically contains from about 20 weight percent to about 100 weight percent, or from about 40 weight percent to about 60 weight percent, of active detergent in the "as delivered" detergent product.

Viscosity Modifiers

Viscosity modifiers (also known as viscosity index improvers (VI improvers), and viscosity improvers) can be included in the lubricant compositions of this disclosure.

Viscosity modifiers provide lubricants with high and low temperature operability. These additives impart shear stability at elevated temperatures and acceptable viscosity at low temperatures.

Suitable viscosity modifiers include high molecular weight hydrocarbons, polyesters and viscosity modifier dispersants that function as both a viscosity modifier and a dispersant. Typical molecular weights of these polymers are between about 10,000 to 1,500,000, more typically about 20,000 to 1,200,000, and even more typically between about 50,000 and 1,000,000.

Examples of suitable viscosity modifiers are linear or star-shaped polymers and copolymers of methacrylate, butadiene, olefins, or alkylated styrenes. Polyisobutylene is a commonly used viscosity modifier. Another suitable viscosity modifier is polymethacrylate (copolymers of various chain length alkyl methacrylates, for example), some formulations of which also serve as pour point depressants. Other suitable viscosity modifiers include copolymers of ethylene and propylene, hydrogenated block copolymers of styrene and isoprene, and polyacrylates (copolymers of various chain length acrylates, for example). Specific examples include styrene-isoprene or styrene-butadiene based polymers of 50,000 to 200,000 molecular weight.

Olefin copolymers are commercially available from Chevron Oronite Company LLC under the trade designation "PARATONE®" (such as "PARATONE® 8921" and "PARATONE® 8941"); from Afton Chemical Corporation under the trade designation "HiTEC®" (such as "HiTEC® 5850B"; and from The Lubrizol Corporation under the trade designation "Lubrizol® 7067C". Hydrogenated polyisoprene star polymers are commercially available from Infineum International Limited, e.g., under the trade designation "SV200" and "SV600". Hydrogenated diene-styrene block copolymers are commercially available from Infineum International Limited, e.g., under the trade designation "SV 50".

The polymethacrylate or polyacrylate polymers can be linear polymers which are available from Evnoik Industries under the trade designation "Viscoplex®" (e.g., Viscoplex 6-954) or star polymers which are available from Lubrizol Corporation under the trade designation Asteric™ (e.g., Lubrizol 87708 and Lubrizol 87725).

Illustrative vinyl aromatic-containing polymers useful in this disclosure may be derived predominantly from vinyl aromatic hydrocarbon monomer. Illustrative vinyl aromatic-containing copolymers useful in this disclosure may be represented by the following general formula:

$$A\text{-}B$$

wherein A is a polymeric block derived predominantly from vinyl aromatic hydrocarbon monomer, and B is a polymeric block derived predominantly from conjugated diene monomer.

In an embodiment of this disclosure, the viscosity modifiers may be used in an amount of less than about 10 weight percent, preferably less than about 7 weight percent, more preferably less than about 4 weight percent, and in certain instances, may be used at less than 2 weight percent, preferably less than about 1 weight percent, and more preferably less than about 0.5 weight percent, based on the total weight of the formulated oil or lubricating engine oil. Viscosity modifiers are typically added as concentrates, in large amounts of diluent oil.

As used herein, the viscosity modifier concentrations are given on an "as delivered" basis. Typically, the active polymer is delivered with a diluent oil. The "as delivered" viscosity modifier typically contains from 20 weight percent to 75 weight percent of an active polymer for polymethacrylate or polyacrylate polymers, or from 8 weight percent to 20 weight percent of an active polymer for olefin copolymers, hydrogenated polyisoprene star polymers, or hydrogenated diene-styrene block copolymers, in the "as delivered" polymer concentrate.

Antioxidants

Antioxidants retard the oxidative degradation of base oils during service. Such degradation may result in deposits on metal surfaces, the presence of sludge, or a viscosity increase in the lubricant. One skilled in the art knows a wide variety of oxidation inhibitors that are useful in lubricating oil compositions. See, Klamann in Lubricants and Related Products, op cite, and U.S. Pat. Nos. 4,798,684 and 5,084,197, for example.

Useful antioxidants include hindered phenols. These phenolic antioxidants may be ashless (metal-free) phenolic compounds or neutral or basic metal salts of certain phenolic compounds. Typical phenolic antioxidant compounds are the hindered phenolics which are the ones which contain a sterically hindered hydroxyl group, and these include those derivatives of dihydroxy aryl compounds in which the hydroxyl groups are in the o- or p-position to each other.

Typical phenolic antioxidants include the hindered phenols substituted with $C_6$+ alkyl groups and the alkylene coupled derivatives of these hindered phenols. Examples of phenolic materials of this type 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol; and 2-methyl-6-t-butyl-4-dodecyl phenol. Other useful hindered mono-phenolic antioxidants may include for example hindered 2,6-di-alkyl-phenolic proprionic ester derivatives. Bis-phenolic antioxidants may also be advantageously used in combination with the instant disclosure. Examples of ortho-coupled phenols include: 2,2'-bis(4-heptyl-6-t-butyl-phenol); 2,2'-bis(4-octyl-6-t-butyl-phenol); and 2,2'-bis(4-dodecyl-6-t-butyl-phenol). Para-coupled bisphenols include for example 4,4'-bis(2,6-di-t-butyl phenol) and 4,4'-methylene-bis(2,6-di-t-butyl phenol).

Effective amounts of one or more catalytic antioxidants may also be used. The catalytic antioxidants comprise an effective amount of a) one or more oil soluble polymetal organic compounds; and, effective amounts of b) one or more substituted N,N'-diaryl-o-phenylenediamine compounds or c) one or more hindered phenol compounds; or a combination of both b) and c). Catalytic antioxidants are more fully described in U.S. Pat. No. 8,048,833, herein incorporated by reference in its entirety.

Non-phenolic oxidation inhibitors which may be used include aromatic amine antioxidants and these may be used either as such or in combination with phenolics. Typical examples of non-phenolic antioxidants include: alkylated and non-alkylated aromatic amines such as aromatic monoamines of the formula $R^8R^9R^{10}N$ where $R^8$ is an aliphatic, aromatic or substituted aromatic group, $R^9$ is an aromatic or a substituted aromatic group, and $R^{10}$ is H, alkyl, aryl or $R^{11}S(O)xR^{12}$ where RH is an alkylene, alkenylene, or aralkylene group, $R^{12}$ is a higher alkyl group, or an alkenyl, aryl, or alkaryl group, and x is 0, 1 or 2. The aliphatic group $R^8$ may contain from 1 to about 20 carbon atoms, and preferably contains from about 6 to 12 carbon atoms. The aliphatic group is a saturated aliphatic group. Preferably, both $R^8$ and $R^9$ are aromatic or substituted aromatic groups, and the aromatic group may be a fused ring aromatic group such as naphthyl. Aromatic groups $R^8$ and $R^9$ may be joined together with other groups such as S.

Typical aromatic amines antioxidants have alkyl substituent groups of at least about 6 carbon atoms. Examples of aliphatic groups include hexyl, heptyl, octyl, nonyl, and decyl. Generally, the aliphatic groups will not contain more than about 14 carbon atoms. The general types of amine antioxidants useful in the present compositions include diphenylamines, phenyl naphthylamines, phenothiazines, imidodibenzyls and diphenyl phenylene diamines. Mixtures of two or more aromatic amines are also useful. Polymeric amine antioxidants can also be used. Particular examples of aromatic amine antioxidants useful in the present disclosure include: p,p'-dioctyldiphenylamine; t-octylphenyl-alpha-naphthylamine; phenyl-alphanaphthylamine; and p-octylphenyl-alpha-naphthylamine.

Sulfurized alkyl phenols and alkali or alkaline earth metal salts thereof also are useful antioxidants.

Preferred antioxidants include hindered phenols, arylamines. These antioxidants may be used individually by type or in combination with one another. Such additives may be used in an amount of about 0.01 to 5 weight percent, preferably about 0.01 to 1.5 weight percent, more preferably zero to less than 1.5 weight percent, more preferably zero to less than 1 weight percent.

Pour Point Depressants (PPDs)

Conventional pour point depressants (also known as lube oil flow improvers) may be added to the compositions of the present disclosure if desired. These pour point depressant may be added to lubricating compositions of the present disclosure to lower the minimum temperature at which the fluid will flow or can be poured. Examples of suitable pour point depressants include polymethacrylates, polyacrylates, polyarylamides, condensation products of haloparaffin waxes and aromatic compounds, vinyl carboxylate polymers, and terpolymers of dialkylfumarates, vinyl esters of fatty acids and allyl vinyl ethers. U.S. Pat. Nos. 1,815,022; 2,015,748; 2,191,498; 2,387,501; 2,655, 479; 2,666,746; 2,721,877; 2,721,878; and 3,250,715 describe useful pour point depressants and/or the preparation thereof. Such additives may be used in an amount of about 0.01 to 5 weight percent, preferably about 0.01 to 1.5 weight percent.

Antiwear Additives

A metal alkylthiophosphate and more particularly a metal dialkyl dithio phosphate in which the metal constituent is zinc, or zinc dialkyl dithio phosphate (ZDDP) can be a useful component of the lubricating oils of this disclosure. ZDDP can be derived from primary alcohols, secondary alcohols or mixtures thereof. ZDDP compounds generally are of the formula $$Zn[SP(S)(OR^1)(OR^2)]_2$$

where $R^1$ and $R^2$ are $C_1$-$C_{18}$ alkyl groups, preferably $C_2$-$C_{12}$ alkyl groups. These alkyl groups may be straight chain or branched. Alcohols used in the ZDDP can be propanol, 2-propanol, butanol, secondary butanol, pentanols, hexanols such as 4-methyl-2-pentanol, n-hexanol, n-octanol, 2-ethyl hexanol, alkylated phenols, and the like. Mixtures of secondary alcohols or of primary and secondary alcohol can be preferred. Alkyl aryl groups may also be used.

Preferable zinc dithiophosphates which are commercially available include secondary zinc dithiophosphates such as those available from for example, The Lubrizol Corporation under the trade designations "LZ 677A", "LZ 1095" and "LZ 1371", from for example Chevron Oronite under the trade designation "OLOA 262" and from for example Afton Chemical under the trade designation "HITEC 7169".

The ZDDP is typically used in amounts of from about 0.3 weight percent to about 1.5 weight percent, preferably from about 0.4 weight percent to about 1.2 weight percent, more preferably from about 0.5 weight percent to about 1.0 weight percent, and even more preferably from about 0.6 weight percent to about 0.8 weight percent, based on the total weight of the lubricating oil, although more or less can often be used advantageously. Preferably, the ZDDP is a secondary ZDDP and present in an amount of from about 0.6 to 1.0 weight percent of the total weight of the lubricating oil.

Seal Compatibility Agents

Seal compatibility agents help to swell elastomeric seals by causing a chemical reaction in the fluid or physical change in the elastomer. Suitable seal compatibility agents for lubricating oils include organic phosphates, aromatic esters, aromatic hydrocarbons, esters (butylbenzyl phthalate, for example), and polybutenyl succinic anhydride. Such additives may be used in an amount of about 0.01 to 3 weight percent, preferably about 0.01 to 2 weight percent.

Antifoam Agents

Anti-foam agents may advantageously be added to lubricant compositions. These agents retard the formation of stable foams. Silicones and organic polymers are typical anti-foam agents. For example, polysiloxanes, such as silicon oil or polydimethyl siloxane, provide antifoam properties. Anti-foam agents are commercially available and may be used in conventional minor amounts along with other additives such as demulsifiers; usually the amount of these additives combined is less than 1 weight percent and often less than 0.1 weight percent.

Inhibitors and Antirust Additives

Antirust additives (or corrosion inhibitors) are additives that protect lubricated metal surfaces against chemical attack by water or other contaminants. A wide variety of these are commercially available.

One type of antirust additive is a polar compound that wets the metal surface preferentially, protecting it with a film of oil. Another type of antirust additive absorbs water by incorporating it in a water-in-oil emulsion so that only the oil touches the metal surface. Yet another type of antirust additive chemically adheres to the metal to produce a non-reactive surface.

Examples of suitable additives include zinc dithiophosphates, metal phenolates, basic metal sulfonates, fatty acids and amines. Such additives may be used in an amount of about 0.01 to 5 weight percent, preferably about 0.01 to 1.5 weight percent.

Friction Modifiers

A friction modifier is any material or materials that can alter the coefficient of friction of a surface lubricated by any lubricant or fluid containing such material(s). Friction modifiers, also known as friction reducers, or lubricity agents or oiliness agents, and other such agents that change the ability of base oils, formulated lubricant compositions, or functional fluids, to modify the coefficient of friction of a lubricated surface may be effectively used in combination with the base oils or lubricant compositions of the present disclosure if desired. Friction modifiers that lower the coefficient of friction are particularly advantageous in combination with the base oils and lube compositions of this disclosure.

Illustrative friction modifiers may include, for example, organometallic compounds or materials, or mixtures thereof. Illustrative organometallic friction modifiers useful in the lubricating engine oil formulations of this disclosure include, for example, molybdenum amine, molybdenum diamine, an organotungstenate, a molybdenum dithiocarbamate, molybdenum dithiophosphates, molybdenum amine complexes, molybdenum carboxylates, and the like, and mixtures thereof. Similar tungsten based compounds may be preferable.

Other illustrative friction modifiers useful in the lubricating engine oil formulations of this disclosure include, for example, alkoxylated fatty acid esters, alkanolamides, polyol fatty acid esters, borated glycerol fatty acid esters, fatty alcohol ethers, and mixtures thereof.

Illustrative alkoxylated fatty acid esters include, for example, polyoxyethylene stearate, fatty acid polyglycol ester, and the like. These can include polyoxypropylene stearate, polyoxybutylene stearate, polyoxyethylene isosterate, polyoxypropylene isostearate, polyoxyethylene palmitate, and the like.

Illustrative alkanolamides include, for example, lauric acid diethylalkanolamide, palmic acid diethylalkanolamide, and the like. These can include oleic acid diethyalkanolamide, stearic acid diethylalkanolamide, oleic acid diethylalkanolamide, polyethoxylated hydrocarbylamides, polypropoxylated hydrocarbylamides, and the like.

Illustrative polyol fatty acid esters include, for example, glycerol mono-oleate, saturated mono-, di-, and tri-glyceride esters, glycerol mono-stearate, and the like. These can include polyol esters, hydroxyl-containing polyol esters, and the like.

Illustrative borated glycerol fatty acid esters include, for example, borated glycerol mono-oleate, borated saturated mono-, di-, and tri-glyceride esters, borated glycerol monosterate, and the like. In addition to glycerol polyols, these can include trimethylolpropane, pentaerythritol, sorbitan, and the like. These esters can be polyol monocarboxylate esters, polyol dicarboxylate esters, and on occasion polyoltricarboxylate esters. Preferred can be the glycerol monooleates, glycerol dioleates, glycerol trioleates, glycerol monostearates, glycerol distearates, and glycerol tristearates and the corresponding glycerol monopalmitates, glycerol dipalmitates, and glycerol tripalmitates, and the respective isostearates, linoleates, and the like. On occasion the glycerol esters can be preferred as well as mixtures containing any of these. Ethoxylated, propoxylated, butoxylated fatty acid esters of polyols, especially using glycerol as underlying polyol can be preferred.

Illustrative fatty alcohol ethers include, for example, stearyl ether, myristyl ether, and the like. Alcohols, including those that have carbon numbers from $C_3$ to $C_{50}$, can be ethoxylated, propoxylated, or butoxylated to form the corresponding fatty alkyl ethers. The underlying alcohol portion can preferably be stearyl, myristyl, $C_{11}$-$C_{13}$ hydrocarbon, oleyl, isosteryl, and the like.

The lubricating oils of this disclosure exhibit desired properties, e.g., wear control, in the presence or absence of a friction modifier.

Useful concentrations of friction modifiers may range from 0.01 weight percent to 5 weight percent, or about 0.1 weight percent to about 2.5 weight percent, or about 0.1 weight percent to about 1.5 weight percent, or about 0.1 weight percent to about 1 weight percent. Concentrations of molybdenum-containing materials are often described in terms of Mo metal concentration. Advantageous concentrations of Mo may range from 25 ppm to 700 ppm or more, and often with a preferred range of 50-200 ppm. Friction modifiers of all types may be used alone or in mixtures with the materials of this disclosure. Often mixtures of two or more friction modifiers, or mixtures of friction modifier(s) with alternate surface active material(s), are also desirable.

When lubricating oil compositions contain one or more of the additives discussed above, the additive(s) are blended into the composition in an amount sufficient for it to perform its intended function. Typical amounts of such additives useful in the present disclosure are shown in Table 1 below.

It is noted that many of the additives are shipped from the additive manufacturer as a concentrate, containing one or more additives together, with a certain amount of base oil diluents. Accordingly, the weight amounts in Table 2 below, as well as other amounts mentioned herein, are directed to the amount of active ingredient (that is the non-diluent portion of the ingredient). The weight percent (wt %) indicated below is based on the total weight of the lubricating oil composition.

TABLE 2

Typical Amounts of Other Lubricating Oil Components

| Compound | Approximate wt % (Useful) | Approximate wt % (Preferred) |
|---|---|---|
| Dispersant | 0.1-20 | 0.1-8 |
| Detergent | 0.1-20 | 0.1-8 |
| Friction Modifier | 0.01-5 | 0.01-1.5 |
| Antioxidant | 0.1-5 | 0.1-1.5 |
| Pour Point Depressant (PPD) | 0.0-5 | 0.01-1.5 |

TABLE 2-continued

| Typical Amounts of Other Lubricating Oil Components | | |
|---|---|---|
| Compound | Approximate wt % (Useful) | Approximate wt % (Preferred) |
| Anti-foam Agent | 0.001-3 | 0.001-0.15 |
| Viscosity Modifier (solid polymer basis) | 0.1-2 | 0.1-1 |
| Antiwear | 0.2-3 | 0.5-1 |
| Inhibitor and Antirust | 0.01-5 | 0.01-1.5 |

The foregoing additives are all commercially available materials. These additives may be added independently but are usually precombined in packages which can be obtained from suppliers of lubricant oil additives. Additive packages with a variety of ingredients, proportions and characteristics are available and selection of the appropriate package will take the requisite use of the ultimate composition into account.

Table 3 below provides the D5293 cold cranking simulator viscosity (CCSV) requirements to classify the SAE W grade of an engine oil. The complete requirements are contained in SAE specification J300. With the exception of the SAE 0W-xx viscosity grades, for every viscosity grade, there is both a maximum CCSV requirement and a minimum CCSV requirement. An additional requirement of the J300 specification is the D4684 MRV viscosity tested at 5° C. lower than the CCSV maximum testing temperature must be ≤60,000 cP with yield stress less than 35 Pa.

TABLE 3

| ASTM D5293 Requirements for Viscosity Grade Determinations | | |
|---|---|---|
| Viscosity Grade | Maximum Requirement | Minimum Requirement |
| 0W-xx | ≤6200 cP at −35° C. | none |
| 5W-xx | ≤6600 cP at −30° C. | >6200 cP at −35° C. |
| 10W-xx | ≤7000 cP at −25° C. | >6600 cP at −30° C. |
| 15W-xx | ≤7000 cP at −20° C. | >7000 cP at −25° C. |
| 20W-xx | ≤9500 cP at −15° C. | >7000 cP at −20° C. |

The following non-limiting examples are provided to illustrate the disclosure.

EXAMPLES

Figure 2:
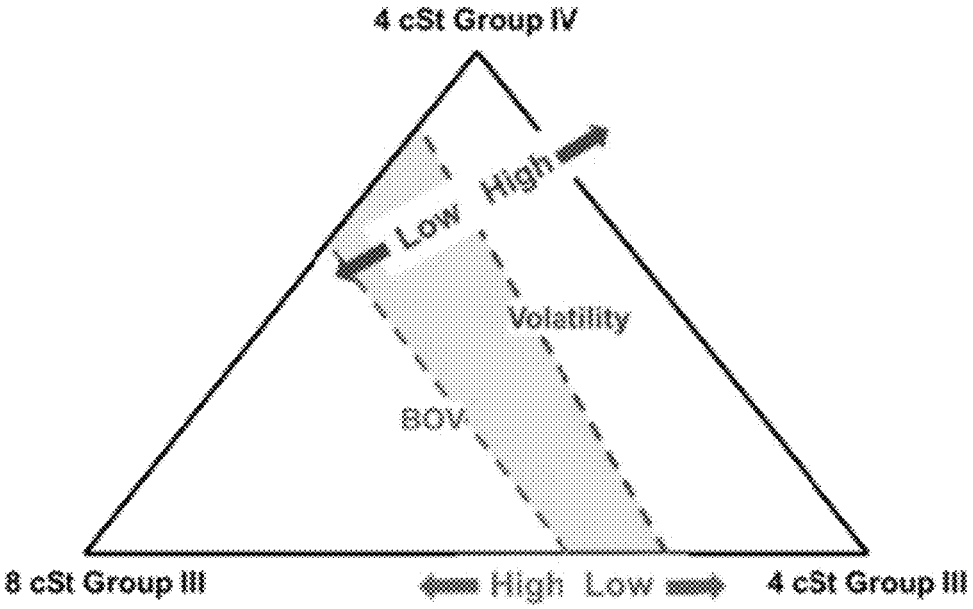
FIG. 2 graphically shows a blending window enabled by base stock formulating approach to make a SAE 5W-xx engine oil in combination with a cobase stock of this disclosure in accordance with Example 1.

FIGS. 1 and 2 demonstrate the utility of the disclosure by showing a blending window enabled by the use of the CCSV boosting cobase stock. In the conventional formulating approach, in order to make an SAE 5W-xx engine oil a combination of higher viscosity base stocks are required to achieve sufficient CCSV at −35° C. This use of higher viscosity base stocks (e.g., >5 cSt Group IV or Group III) results in a higher base oil viscosity which leads to reduced fuel economy and energy efficiency. To reduce the base oil viscosity, a lower viscosity index base stock (e.g., Group II) can be used since its lower temperature viscosity changes more rapidly with temperature. While this approach achieves a lower base oil viscosity, and concurrent recovery of energy efficiency and fuel economy, other performance concessions are made. For example, the Noack volatility of a formulation containing low viscosity Group II base stocks increases which can lead to issues with deposits or cleanliness.

FIG. 1 shows a blending window for an SAE 5W-30 engine oil. When constructing these blending windows the high temperature high shear viscosity (HTHS), kinematic viscosity at 100° C. (KV100), Noack volatility, base oil viscosity (BOV), and cold crank simulator viscosity (CCSV) at −35° C. were determined for a wide range of formulated oils with various base oil combinations. The additives and viscosity modifier concentrations were held constant and the base oil mixture adjusted. A Simplex Centroid experimental design was used to determine the aforementioned physical properties of various formulations with base oil components comprising Group IV—4, Group II—4.5, and Group III—C6 base stocks. The lines in FIG. 1 correspond to boundary conditions of ≤15% Noack volatility, ≤5.5 cSt base oil viscosity (i.e., KV100 of the base oil mixture), and >6200 cP CCSV at −35° C. These boundary conditions were the most restrictive to define an SAE 5W-30 formulation with these base stocks. In this case the BOV limit of 5.5 cSt was selected arbitrarily as a cutoff.

FIG. 1 graphically shows the impact which was previously discussed. The vertices of the triangle correspond to the base oil mixture containing 100% of the indicated component. As more Group IV—4 base stock is included in the formulation, the oil becomes limited by meeting the CCSV definition for a 5W-xx grade. Furthermore as more heavy cut base stock (i.e., 6 cSt Group III) is added the formulation begins to become limited by the increasing base oil viscosity. And lastly, as more Group II—4.5 is added, the formulation becomes limited by the Noack volatility.

Using the C28 methyl paraffin cobase stock with a $Kv_{100}$<4 cSt, but which thickens significantly at low temperatures, removes the constraint to use low viscosity, low viscosity index Group II base stocks, enabling formulations with low base oil viscosity, acceptable volatility, and comprising fully synthetic base stocks. This is graphically shown in FIG. 2. FIG. 2 is constructed the same as FIG. 1, except the formulations contain a constant 7.5 wt % of the C28 methyl paraffin cobase. The base oil mixture has also changed to Group IV—4, Group III—A4, or a Group III—A8. The constraint on the CCSV is removed when using the CCSV boosting base stock, and there is a significant increase in the blending window to produce an SAE 5W-30 lubricant. It is also important to note that although there is still a Noack volatility limitation present in FIG. 2, the slope of the line is less than when including a Group II—4.5 base stock as in FIG. 1. This shows that it is possible to formulate a lubricant with lower base oil viscosity using a CCSV boosting base stock while also having improved Noack volatility. These improvements would be expected to provide improved deposit performance and reduced oil consumption for in-service lubricants.

In accordance with this disclosure, the preferred CCSV boosting molecule is a $C_{28}$ methyl paraffin (referred to as "C28MP"), decyl palmitate, coconut oil or C18 dimer. This molecule is synthesized using the metallocene PAO process by dimerizing $C_{14}$ alpha olefins. This molecule is solid at room temperature, but soluble in other base stocks at a wide range of temperatures. When preferably used at between 3-10% in a lubricating oil formulation, the C28MP gives an apparent CCSV at −35° C. of approximately 2,500,000 cP. FIG. 3 shows some additional properties of the C28MP, decyl palmitate, coconut oil and C18 dimer.

Figure 4:
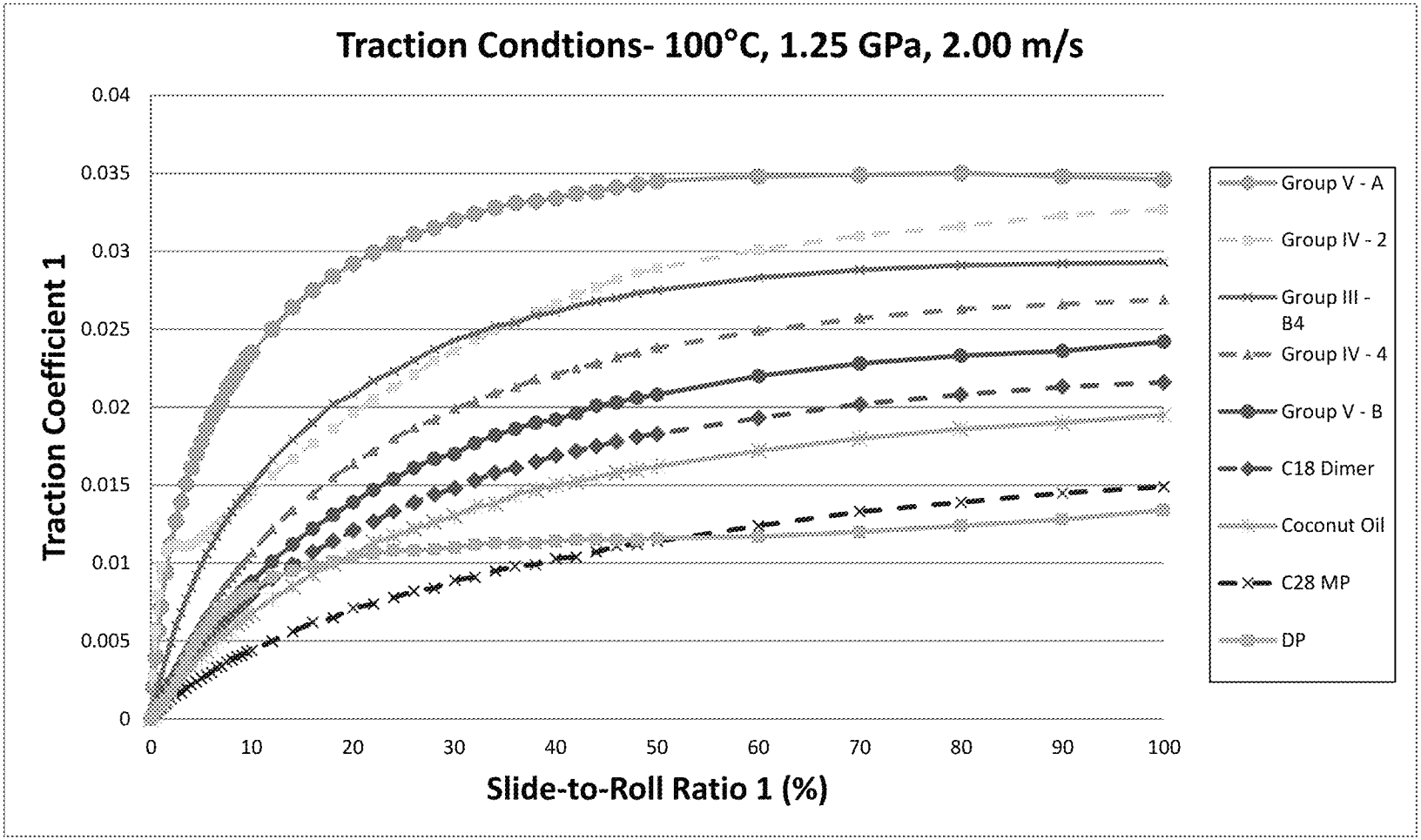
FIG. 4 graphically shows a comparison of MTM (Mini Traction Machine) traction test results for PAO 2, PAO 4, Group III—B (4cSt), Group V=A, Group V—B, and a cobase stock of this disclosure (i.e., C28 methyl paraffin, decyl palmitate, coconut oil and C18 dimer).

Additionally, the C28MP, decyl palmitate, coconut oil, and C18 dimer surprisingly shows significant benefits in MTM traction. FIG. 4 shows a comparison of MTM traction results for PAO 2, PAO 4, C28MP, Group III—B4, Group V—A, decyl palmitate, coconut oil, and C18 dimer and Group V—B. Note that the C28MP, decyl palmitate, coconut oil, and C18 dimer shows a significantly lower traction coefficient across a range of slide-roll ratios. Such an improvement in MTM traction is expected to provide significant energy efficiency benefits in a variety of applications. Importantly, it is likely that a significant fraction of C28MP, decyl palmitate, coconut oil, and C18 dimer would need to be used as the base oil in a formulation to see such surprising and pronounced traction benefits. As such, the low temperature properties of such a formulation may not be suitable for an automotive engine oil which needs to meet an SAE J300 viscosity grade. However such a formulation would be very useful for applications at temperatures >30° C.

Typical properties of base stocks used in the Examples are shown in FIG. 5.

Selected cobase stocks of this disclosure and commercial base stocks were used to formulate engine oils. Each formulation consisted of a % by weight of the listed base stock, a % by weight of the listed cobase stock, a % by weight of a listed additive, and a % by weight of a listed additive package, as shown in FIGS. 6-10. The additive package employed is composed of commonly used additive components (e.g., viscosity modifiers, antiwear additives, friction modifiers, dispersants, detergents, antioxidants, pour point depressants, antifoaming agent, etc.).

Kinematic viscosity ($Kv_{100}$) of the lubricating oil as determined by ASTM D445, kinematic viscosity ($Kv_{40}$) of the lubricating oil as determined by ASTM D445, cold cranking simulator (CCS-35) viscosity of the lubricating oil as determined by ASTM D5293-15, cold cranking simulator (CCS-30) viscosity of the lubricating oil as determined by ASTM D5293-15, high temperature high shear (HTHS) viscosity as determined by ASTM D4683, viscosity (MRV) of the lubricating oil as determined by ASTM D4684, viscosity index (VI) as determined by ASTM D2270, yield stress as determined by ASTM D4684-14, Noack volatility as determined by ASTM D5800, pour point as determined by ASTM D97-16, gelation index as determined by ASTM D5133-15, gelation temperature as determined by ASTM D5133-15, results for engine oils formulated with cobase stocks of this disclosure are shown in FIGS. 6-10.

FIG. 6 demonstrates the utility of the disclosure by showing how 5W-30 and 10W-30 engine oils can be formulated with the C28 methyl paraffin to lower base oil viscosity at 100° C. and improve fuel efficiency while maintaining a desired viscosity grade. In FIG. 6, the viscosity modifier used in all comparative and inventive examples was a hydrogenated isoprene star polymer having a Mn of 329,000, a Mw of 870,000 (determined by light scattering), and a polydispersity index of 2.6. Comparative example 1 shows properties of a 5W-30 engine oil formulated with base stock Group III—A4 and Group III—A8. This is a mix of a 4 cSt fluid and a 8 cSt cut. Key properties to note are the base oil viscosity at 100° C. is 5.66 cSt and the CCSV at −35° C. is 6890 cP. Based on the CCSV, comparative example 1 is a 5W engine oil. In comparative example 2, the Group III—A base stock mixture is rebalanced to reduce the base oil viscosity at 100° C. to 4.11 cSt. This base oil rebalance is expected to improve fuel economy performance (Crosthwait et al.). This formulation has a D5293 CCSV at −35° C. of 4020 cP and would be classified as an 0W-30 engine oil.

In inventive example 1, 7.5% of the C28 methyl paraffin cobase is added to the Group III—A base stock mix which was rebalanced to maintain the D5293 CCSV (6890 cP at −35° C.). The resulting formulation has a base oil viscosity at 100° C. is 4.05 cSt and the CCSV at −35° C. is 7150 cP. Based on the D5293 CCSV, inventive example 1 is a 5W-30 engine oil. The addition of the C28 methyl paraffin cobase resulted in a significant reduction in the base oil viscosity at 100° C. while having an insignificant impact on the CCSV at −35° C. and thus maintaining the original viscosity grade of 5W. Other low temperature properties for inventive example 1 such at MRV at −40° C., pour point, and scanning Brookfield gelation index are excellent.

Comparative example 3 shows properties of a 5W-30 engine oil formulated with a mix of Group III—A8 base stocks and Group IV—4. Key properties to note are the base oil viscosity at 100° C. is 5.75 cSt and the CCSV at −35° C. is 6520 cP. Based on the CCSV, comparative example 3 is a 5W-30 engine oil. In comparative example 4, the Group III—A base stock mixture is rebalanced to reduce the base oil viscosity at 100° C. to 4.12 cSt. This base oil rebalance is expected to improve fuel economy performance (Crosthwait et al.). This formulation has a D5293 CCSV at −35° C. of 3530 cP and would be classified as an 0W-30 engine oil. In inventive example 2, 8.2% of the C28 methyl paraffin cobase is added to the Group III—A base stock mixture and Group IV base oil. The Group III—A base oils were rebalanced to maintain the original CCSV. The resulting formulation has a base oil viscosity at 100° C. is 4.05 cSt and the D5293 CCSV at −35° C. is 7500 cP. Based on the CCSV, inventive example 2 is a 5W-30 engine oil. The addition of the C28 methyl paraffin cobase resulted in a significant reduction in the base oil viscosity at 100° C. while having an insignificant impact on the CCSV at −35° C. and thus maintaining the original viscosity grade of 5W. Other low temperature properties for inventive example 2 such at MRV at −40° C., pour point, and scanning Brookfield gelation index are excellent.

Comparative example 5 shows properties of a 5W-30 engine oil formulated with a mix of base stock Group III—A4 and Group—II6. Key properties to note are the base oil viscosity at 100° C. is 5.50 cSt and the D5293 CCSV at −30° C. is 7620 cP. Based on the CCSV, comparative example 3 is a 10W-30 engine oil. In comparative example 6, the Group III—A base stock mixture is rebalanced to reduce the base oil viscosity at 100° C. to 5.00 cSt. This base oil rebalance is expected to improve fuel economy performance (Crosthwait et al.). This formulation has a D5293 CCSV at −30° C. of 4780 cP and would be classified as an 5W-30 engine oil. In inventive example 3, 9.8% of the C28 methyl paraffin cobase is added to base stock Group III—A, Group II base oil mix. The resulting formulation has a base oil viscosity at 100° C. is 5.00 cSt and the D5293 CCSV at −30° C. is 6701 cP. Based on the CCSV, inventive example 3 is a 10W-30 engine oil. The addition of the C28 methyl paraffin cobase resulted in a significant reduction in the base oil viscosity at 100° C. while having an insignificant impact on the CCSV at −30° C. and thus maintaining the original viscosity grade of 10W-30.

In FIG. 7, the viscosity modifier used in all comparative and inventive examples was a styrene isoprene block polymer having a Mn of 149,000, a Mw of 150,000 (determined by light scattering), and a polydispersity index of 1.0. In FIG. 7, comparative example 7 shows properties of a 5W-30 engine oil formulated with a mix of base stock Group III—C6, Group II—4.5, and Group IV—4. Key properties to note are the base oil viscosity at 100° C. is 4.93 cSt and the D5293 CCSV at −35° C. is 8120 cP. Based on the CCSV, comparative example 7 is a 5W-30 engine oil. In comparative example 8, the base stock mix in comparative example 7 is rebalanced to lower the base oil viscosity at 100° C. to 4.45 cSt. This is expected to provide a fuel economy benefit (Crosthwait et al.). The D5293 CCSV at −35° C. is 5660 cP. Based on the viscosity properties, Comparative example 8 is a 0W-30 engine oil. Thus, as a result of the base stock rebalance the viscosity grade of the engine oil changed. In inventive example 4, 5% of the C28 methyl paraffin cobase is added to base stock Group III—C, Group II—4.5, Group IV—4 base oil mix. The resulting formulation has a base oil viscosity at 100° C. is 4.45 cSt and the D5293 CCSV at −35° C. is 8280 cP. Based on the CCSV, inventive example 4 is a 5W-30 engine oil. The addition of the C28 methyl paraffin cobase resulted in a significant reduction in the base oil viscosity at 100° C. while having an insignificant impact on the CCSV at −35° C. and thus maintaining the original viscosity grade of 5W-30. This base oil rebalance is expected to improve fuel economy performance (Crosthwait et al.). In addition, inventive example 4 maintains good low temperature properties including pour point, MRV at −40° C., and scanning Brookfield gelation index. In addition, inventive example 4 maintains good high temperature deposit control (TEOST 33C).

In FIG. 8, the viscosity modifier used in all comparative and inventive examples was a hydrogenated isoprene star polymer having a Mn of 329,000, a Mw of 870,000 (determined by light scattering), and a polydispersity index of 2.6. In FIG. 8, comparative example 9 shows properties of a 5W-30 engine oil formulated with a base stock Group III—A4 and Group III—A8. Key properties to note are the base oil viscosity at 100° C. is 5.91 cSt and the CCSV at −35° C. is 8670 cP. Based on the CCSV, comparative example 9 is a 5W-30 engine oil. In comparative example 10, the base stock mix in comparative example 9 is rebalanced to lower the base oil viscosity at 100° C. to 4.79 cSt. This is expected to provide a fuel economy benefit (Crosthwait et al.). The D5293 CCSV at −35° C. is 5490 cP. Based on the viscosity properties, Comparative example 10 is a 0W-30 engine oil. Thus, as a result of the base stock rebalance the viscosity grade of the engine oil changed. In inventive example 5, 5% of the C28 methyl paraffin cobase is added to base stock Group III—A4 and Group III—A8 mix that was rebalanced to maintain constant CCSV. The resulting formulation has a base oil viscosity at 100° C. is 4.80 cSt and the CCSV at −35° C. is 7680 cP. Based on the CCSV, inventive example 5 is a 5W-30 engine oil. The addition of the C28 methyl paraffin cobase resulted in a significant reduction in the base oil viscosity at 100° C. while having an insignificant impact on the CCSV at −35° C. and thus maintaining the original viscosity grade of 5W-30. This base oil rebalance is expected to improve fuel economy performance (Crosthwait et al.). In addition, inventive example 5 maintains good low temperature properties including pour point, MRV at −40° C., and scanning Brookfield gelation index. In addition, inventive example 5 maintains good high temperature deposit control (TEOST 33C) and good oil aging viscosity control (CEC L105 LTPT).

Comparative example 11 shows properties of a 5W-30 engine oil formulated with a Group IV—6 and Group III—B6 base stock mix. Key properties to note are the base oil viscosity at 100° C. is 5.79 cSt and the CCSV at −35° C. is 6900 cP. Based on the CCSV, comparative example 11 is a 5W-30 engine oil. In comparative example 12, the base stock mix in comparative example 11 is rebalanced to lower the base oil viscosity at 100° C. to 4.66 cSt. This is expected to provide a fuel economy benefit (Crosthwait et al.). The D5293 CCSV at −35° C. is 4270 cP. Based on the viscosity properties, Comparative example 12 is a 0W-30 engine oil. Thus, as a result of the base stock rebalance the viscosity grade of the engine oil changed. In inventive example 6, 5% of the C28 methyl paraffin cobase is added to the Group IV and Group III—B6 base oil mix that was rebalanced to maintain constant CCSV. The resulting formulation has a base oil viscosity at 100° C. of 4.7 cSt and the CCSV at −35° C. is 6260 cP. Based on the CCSV, inventive example 6 is a 5W engine oil. The addition of the C28 methyl paraffin cobase resulted in a significant reduction in the base oil viscosity at 100° C. while having an insignificant impact on the CCSV at −35° C. and thus maintaining the original viscosity grade of 5W-30. This base oil rebalance is expected to improve fuel economy performance (Crosthwait et al.). In addition, inventive example 6 maintains good low temperature properties including pour point, MRV at −40° C., and scanning Brookfield gelation index.

Comparative example 13 shows properties of a 5W-30 engine oil formulated with a Group III—A4, Group III—A8, and Group III—B6 base stock mix. Key properties to note are the base oil viscosity at 100° C. is 5.74 cSt and the CCSV at −35° C. is 8550 cP. Based on the CCSV, comparative example 13 is a 5W-30 engine oil. In comparative example 14, the base stock mix in comparative example 13 is rebalanced to lower the base oil viscosity at 100° C. to 4.52 cSt. This is expected to provide a fuel economy benefit (Crosthwait et al.). The D5293 CCSV at −35° C. is 5080 cP. Based on the viscosity properties, Comparative example 14 is a 0W-30 engine oil. Thus, as a result of the base stock rebalance the viscosity grade of the engine oil changed. In inventive example 7, 5% of the C28 methyl paraffin cobase is added to the Group III—A4 and Group III—B6 base stock mix. The resulting formulation has a base oil viscosity at 100° C. of 4.5 cSt and the CCSV at −35° C. is 7520 cP. Based on the CCSV, inventive example 7 is a 5W-30 engine oil. The addition of the C28 methyl paraffin cobase resulted in a significant reduction in the base oil viscosity at 100° C. while having an insignificant impact on the CCSV at −35° C. and thus maintaining the original viscosity grade of 5W-30. This base oil rebalance is expected to improve fuel economy performance (Crosthwait et al.). In addition, inventive example 7 maintains good low temperature properties including pour point, MRV at −40° C., and scanning Brookfield gelation index. In addition, inventive example 7 maintains good high temperature deposit control (TEOST 33C) and good oil aging viscosity control (CEC L105 LTPT).

Comparative example 15 shows properties of a 5W-30 engine oil formulated with a Group III—A8 and Group IV—6 base stock mix. Key properties to note are the base oil viscosity at 100° C. is 5.97 cSt and the CCSV at −35° C. is 7110 cP. Based on the CCSV, comparative example 15 is a 5W-30 engine oil. In comparative example 16, the base stock mix in comparative example 14 is rebalanced to lower the base oil viscosity at 100° C. to 4.8 cSt. This is expected to provide a fuel economy benefit (Crosthwait et al.). The D5293 CCSV at −35° C. is 4510 cP. Based on the viscosity properties, Comparative example 16 is a 0W-30 engine oil. Thus, as a result of the base stock rebalance the viscosity grade of the engine oil changed. In inventive example 8, 5% of the C28 methyl paraffin cobase is added to the Group III—A and Group IV base stock mix which was rebalanced to maintain CCSV. The resulting formulation has a base oil viscosity at 100° C. of 4.8 cSt and the CCSV at −35° C. is 6700 cP. Based on the CCSV, inventive example 8 is a 5W-30 engine oil. The addition of the C28 methyl paraffin cobase resulted in a significant reduction in the base oil viscosity at 100° C. while having an insignificant impact on the CCSV at −35° C. and thus maintaining the original viscosity grade of 5W-30. This base oil rebalance is expected to improve fuel economy performance (Crosthwait et al.). In addition, inventive example 8 maintains good low temperature properties including pour point, MRV at −40° C., and scanning Brookfield gelation index. In addition, inventive example 8 maintains good high temperature deposit control (TEOST 33C), good oil aging viscosity control (CEC L105 LTPT and ROBO D7528) and excellent oxidation stability (D7528% viscosity increase at 40°).

FIG. 9 provides comparative and inventive examples where decyl palmitate or coconut oil was used to reduce the base oil viscosity at 100° C. while maintaining a constant CCSV. The viscosity modifier for all comparative and inventive examples in FIG. 9 was a hydrogenated isoprene star polymer with a bimodal molecular weight distribution. The primary peak has a Mw of 1,050,000, a Mn of 939,000 (as determined by light scattering) and a polydispersity index of 1.12. The viscosity modifier has a secondary peak which has a Mw of 282,000, a Mn of 268,000 (as determined by light scattering) and a polydispersity index of 1.05. Comparative example 17 shows properties of a 5W-30 engine oil formulated with a Group II—4, Group III—A4, Group IV 4, and Group V—A as the base stock mix. Key properties to note are the base oil viscosity at 100° C., which was 4.38 cSt and the CCSV at −35° C., which was 7570 cP. Based on the CCSV, comparative example 17 is a 5W-30 engine oil. In inventive example 9, 5% of decyl palmitate cobase replaceed Group V—A and Group II—4 and Group III—A4 base stocks were rebalanced so that the CCSV at −35° C. of inventive example 9 matched the CCSV at −35° C. of comparative example 17. The resulting formulation had a base oil viscosity at 100° C. of 4.13 cSt and the CCSV at −35° C. was 7490 cP. Based on the CCSV, inventive example 9 was a 5W-30 engine oil. The addition of the decyl palmitate cobase resulted in a significant reduction in the base oil viscosity at 100° C. while having an insignificant impact on the CCSV at −35° C. and thus maintained the original viscosity grade of 5W-30. This base oil rebalance was expected to improve fuel economy performance (Crosthwait et al.). In addition, inventive example 9 maintained good low temperature properties including pour point, and scanning Brookfield gelation index. Comparative example 18 showed properties of a 10W-30 engine oil formulated with a Group II—4, Group II—6, Group IV—4, and Group V—A as the base stock mix. Key properties to note were the base oil viscosity at 100° C., which was 4.96 cSt and the CCSV at −30° C., which was 6850 cP. Based on the CCSV, comparative example 18 was a 10W-30 engine oil. In inventive example 10, 5% of decyl palmitate cobase replaced Group V—A and Group II—4 and Group II—6 base stocks were rebalanced so that the CCSV at −30° C. of inventive example 10 matched the CCSV at −30° C. of comparative example 18. The resulting formulation had a base oil viscosity at 100° C. of 4.54 cSt and the CCSV at −30° C. was 7120 cP. Based on the CCSV, inventive example 10 was a 10W-30 engine oil. The addition of the decyl palmitate cobase resulted in a significant reduction in the base oil viscosity at 100° C. while having an insignificant impact on the CCSV at −30° C. and thus maintained the original viscosity grade of 10W-30. This base oil rebalance was expected to improve fuel economy performance (Crosthwait et al.). In addition, inventive example 10 maintained good low temperature properties including pour point, and scanning Brookfield gelation index.

Comparative example 19 showed the properties of a 5W-30 engine oil formulated with a Group III—B4, Group III—B6, Group IV—4, and Group V—A as the base stock mix. Key properties to note are the base oil viscosity at 100° C., which was 4.48 cSt and the CCSV at −35° C., which was 8130 cP. Based on the CCSV, comparative example 19 was a 5W-30 engine oil. In inventive example 11, 5% of decyl palmitate cobase replaced Group V—A and Group III—B4 and Group III—B6 base stocks, which were rebalanced so that the CCSV at −35° C. of inventive example 11 matched the CCSV at −35° C. of comparative example 19. The resulting formulation had a base oil viscosity at 100° C. of 4.10 cSt and the CCSV at −35° C. of 7740 cP. Based on the CCSV, inventive example 11 was a 5W-30 engine oil. The addition of the decyl palmitate cobase resulted in a significant reduction in the base oil viscosity at 100° C. while having an insignificant impact on the CCSV at −35° C. and thus maintained the original viscosity grade of 5W-30. This base oil rebalance was expected to improve fuel economy performance (Crosthwait et al.). In addition, inventive example 11 maintained good low temperature properties including pour point, and scanning Brookfield gelation index. Comparative example 20 showed properties of a 10W-30 engine oil formulated with a Group III—B4, Group III—B6, Group IV—4, and Group V—A as the base stock mix. Key properties to note were the base oil viscosity at 100° C. of 5.76 cSt and the CCSV at −30° C. of 7250 cP. Based on the CCSV, comparative example 20 was a 10W-30 engine oil. In inventive example 12, 5% of decyl palmitate cobase replaced Group V—A and Group III—B4 and Group III—B6 base stocks were rebalanced so that the CCSV at −30° C. of inventive example 12 matched the CCSV at −30° C. of comparative example 20. The resulting formulation had a base oil viscosity at 100° C. of 5.02 cSt and the CCSV at −30° C. of 7140 cP. Based on the CCSV, inventive example 12 was a 10W-30 engine oil. The addition of the decyl palmitate cobase resulted in a significant reduction in the base oil viscosity at 100° C. while having an insignificant impact on the CCSV at −30° C. and thus maintained the original viscosity grade of 10W-30. This base oil rebalance was expected to improve fuel economy performance (Crosthwait et al.). In addition, inventive example 12 maintained good low temperature properties including pour point, and scanning Brookfield gelation index.

Comparative example 21 showed properties of a 5W-30 engine oil formulated with a Group III—A4, Group III—A8, Group IV—4, and Group V—A as the base stock mix. Key properties to note were the base oil viscosity at 100° C. of 5.18 cSt and the CCSV at −35° C. of 7820 cP. Based on the CCSV, comparative example 21 was a 5W-30 engine oil. In inventive example 13, 5% of decyl palmitate cobase replaced Group V—A and Group III—A4 and Group III—A8 base stocks were rebalanced so that the CCSV at −35° C. of inventive example 13 matched the CCSV at −35° C. of comparative example 21. The resulting formulation had a base oil viscosity at 100° C. of 4.49 cSt and the CCSV at −35° C. of 7810 cP. Based on the CCSV, inventive example 13 was a 5W-30 engine oil. The addition of the decyl palmitate cobase resulted in a significant reduction in the base oil viscosity at 100° C. while having an insignificant impact on the CCSV at −35° C. and thus maintained the original viscosity grade of 5W-30. This base oil rebalance was expected to improve fuel economy performance (Crosthwait et al.). In addition, inventive example 13 maintained good low temperature properties including scanning Brookfield gelation index. Comparative example 22 showed properties of a 10W-30 engine oil formulated with a Group III—A4, Group III—A8, Group IV—4, and Group V—A as the base stock mix. Key properties to note were the base oil viscosity at 100° C. of 6.66 cSt and the CCSV at −30° C. of 7150 cP. Based on the CCSV, comparative example 22 was a 10W-30 engine oil. In inventive example 14, 5% of decyl palmitate cobase replaced Group V—A and Group III—A4 and Group III—A8 base stocks were rebalanced so that the CCSV at −30° C. of inventive example 14 matched the CCSV at −30° C. of comparative example 22. The resulting formulation had a base oil viscosity at 100° C. of 5.90 cSt and the CCSV at −30° C. of 7350 cP. Based on the CCSV, inventive example 14 was a 10W-30 engine oil. The addition of the decyl palmitate cobase resulted in a significant reduction in the base oil viscosity at 100° C. while having an insignificant impact on the CCSV at −30° C. and thus maintained the original viscosity grade of 10W-30. This base oil rebalance was expected to improve fuel economy performance (Crosthwait et al.). In addition, inventive example 10 maintained good low temperature properties including pour point, and scanning Brookfield gelation index.

Comparative example 21 showed properties of a 5W-30 engine oil formulated with a Group III—A4, Group III—A8, Group IV—4, and Group V—A as the base stock mix. Key properties to note were the base oil viscosity at 100° C. of 5.18 cSt and the CCSV at −35° C. of 7820 cP. Based on the CCSV, comparative example 21 is a 5W-30 engine oil. In inventive example 15, 5% of coconut oil cobase replaced Group V—A and Group III—A4 and Group III—A8 base stocks were rebalanced so that the CCSV at −35° C. of inventive example 15 matched the CCSV at −35° C. of comparative example 21. The resulting formulation had a base oil viscosity at 100° C. of 4.51 cSt and the CCSV at −35° C. of 7800 cP. Based on the CCSV, inventive example 15 was a 5W-30 engine oil. The addition of the coconut oil cobase resulted in a significant reduction in the base oil viscosity at 100° C. while having an insignificant impact on the CCSV at −35° C. and thus maintained the original viscosity grade of 5W-30. This base oil rebalance was expected to improve fuel economy performance (Crosthwait et al.). In addition, inventive example 15 maintained good low temperature properties including pour point and scanning Brookfield gelation index. FIG. 10 provides comparative and inventive examples where decyl palmitate was used to reduce the base oil viscosity at 100° C. while maintaining a constant CCSV. The viscosity modifier for all comparative and inventive examples in FIG. 10 was a hydrogenated isoprene star polymer with a bimodal molecular weight distribution. The primary peak has a Mw of 1,050,000, a Mn of 939,000 (as determined by light scattering) and a polydispersity index of 1.12. The viscosity modifier has a secondary peak which has a Mw of 282,000, a Mn of 268,000 (as determined by light scattering) and a polydispersity index of 1.05. Comparative example 21 showed properties of a 5W-30 engine oil formulated with a Group III—A4, Group III—A8, Group IV—4, and Group V—A as the base stock mix. Key properties to note were the base oil viscosity at 100° C. of 5.18 cSt and the CCSV at −35° C. of 7820 cP. Based on the CCSV, comparative example 21 was a 5W-30 engine oil. In inventive example 16, 2% of decyl palmitate cobase replaced Group V—A and the Group III—A4 and Group III—A8 basestocks were rebalanced so that the CCSV at −35° C. of inventive example 16 matched the CCSV at −35° C. of comparative example 21. The resulting formulation had a base oil viscosity at 100° C. of 5.07 cSt and the CCSV at −35° C. of 7950 cP. Based on the CCSV, inventive example 16 was a 5W-30 engine oil. The addition of the decyl palmitate cobase resulted in a significant reduction in the base oil viscosity at 100° C. while having an insignificant impact on the CCSV at −35° C. and thus maintained the original viscosity grade of 5W-30. This base oil rebalance was expected to improve fuel economy performance (Crosthwait et al.). In addition, inventive example 16 maintained good low temperature properties including pour point and scanning Brookfield gelation index. In inventive example 13, 5% of decyl palmitate cobase replaces Group V—A and the Group III—A4 and Group III—A8 basestocks were rebalanced so that the CCSV at −35° C. of inventive example 13 matches the CCSV at −35° C. of comparative example 21. The resulting formulation had a base oil viscosity at 100° C. of 4.49 cSt and the CCSV at −35° C. of 7810 cP. Based on the CCSV, inventive example 13 was a 5W-30 engine oil. The addition of the decyl palmitate cobase resulted in a significant reduction in the base oil viscosity at 100° C. while having an insignificant impact on the CCSV at −35° C. and thus maintained the original viscosity grade of 5W-30. This base oil rebalance was expected to improve fuel economy performance (Crosthwait et al.). In addition, inventive example 13 maintained good low temperature properties including scanning Brookfield gelation index. In inventive example 17, 8% of decyl palmitate cobase replaced Group V—A and the Group III—A4 and Group III—A8 basestocks were rebalanced so that the CCSV at −35° C. of inventive example 17 matched the CCSV at −35° C. of comparative example 21. The resulting formulation had a base oil viscosity at 100° C. of 4.38 cSt and the CCSV at −35° C. of 7910 cP. Based on the CCSV, inventive example 17 was a 5W-30 engine oil. The addition of the decyl palmitate cobase resulted in a significant reduction in the base oil viscosity at 100° C. while having an insignificant impact on the CCSV at −35° C. and thus maintained the original viscosity grade of 5W-30. This base oil rebalance was expected to improve fuel economy performance (Crosthwait et al.). In addition, inventive example 17 maintained good low temperature properties including pour point. In inventive example 18, 12% of decyl palmitate cobase replaced Group V—A and the Group III—A4 and Group III—A8 basestocks were rebalanced so that the CCSV at −35° C. of inventive example 17 matched the CCSV at −35° C. of comparative example 21. The resulting formulation had a base oil viscosity at 100° C. of 4.22 cSt and the CCSV at −35° C. of 8400 cP. Based on the CCSV, inventive example 18 was a 5W-30 engine oil. The addition of the decyl palmitate cobase resulted in a significant reduction in the base oil viscosity at 100° C. while having an insignificant impact on the CCSV at −35° C. and thus maintained the original viscosity grade of 5W-30. This base oil rebalance was expected to improve fuel economy performance (Crosthwait et al.). In addition, inventive example 18 maintained good low temperature properties including pour point.

The lubricating oils of this disclosure provide improved fuel efficiency and energy efficiency. A lower HTHS viscosity engine oil generally provides superior fuel economy to a higher HTHS viscosity product. This benefit can be demonstrated for the lubricating oils of this disclosure in the Sequence VID Fuel Economy (ASTM D7589) engine test. The lubricating oils of this disclosure provide improved or maintained deposit control and cleanliness performance. This benefit is demonstrated for the lubricating oils of this disclosure in the Sequence IIIG engine tests (ASTM D7320).

FIGS. 6-10 show several blends and properties Blends with viscometries as low as SAE 0W-8 engine oils have been modeled which can incorporate up to 12 wt % of this C28MP, while still meeting SAE 0W viscometric specifications. At 12 wt %, the traction benefits may be tangible, while the volatility of the formulation may be too high to meet other industry specifications.

PCT and EP Clauses:

1. A lubricating oil comprising a base oil mixture, wherein the base oil mixture comprises a lubricating oil base stock as a major component; and at least one cobase stock as a minor component at from 1 to 15 wt. % of the lubricating oil having a kinematic viscosity ($Kv_{100}$) of less than about 6.2 cSt at 100° C., to reduce kinematic viscosity ($Kv_{100}$) of the base oil mixture as determined by ASTM D445, while maintaining or controlling cold cranking simulator viscosity (CCSV) of the lubricating oil as determined by ASTM D5293-15, such that the lubricating oil meets both kinematic viscosity ($Kv_{100}$) and cold cranking simulator viscosity (CCSV) requirements for a SAE engine oil grade as determined by SAE J300 viscosity grade classification system.

2. The lubricating oil of clause 1 wherein the at least one cobase stock is a $C_{20-36}$ polyalphaolefin, a $C_{24-32}$ polyalphaolefin, a $C_{24-28}$ polyalphaolefin, or mixtures thereof, and having from about 1 to about 4 branch points.

3. The lubricating oil of clauses 1 and 2 wherein the at least one cobase stock is a dimerized, hydrogenated $C_{14}$ linear alphaolefin having a kinematic viscosity ($Kv_{100}$) less than about 4 cSt at 100° C. as determined by ASTM D445.

4. The lubricating oil of clauses 1-3 which has a kinematic viscosity ($Kv_{100}$) from about 2 cSt to about 12 cSt at 100° C. as determined by ASTM D445, a cold cranking simulator viscosity (CCSV) at −35° C. from about 1000 cP to about 6200 cP as determined by ASTM D5293-15, a cold cranking simulator viscosity (CCSV) at −30° C. from about 1000 cP to about 6600 cP as determined by ASTM D5293-15, a cold cranking simulator viscosity (CCSV) at −25° C. from about 1000 cP to about 7000 cP as determined by ASTM D5293-15, and a high temperature high shear (HTHS) viscosity of less than about 3.5 cP as determined by ASTM D4683-13.

5. The lubricating oil of clauses 1-4 having a viscosity index (VI) from about 80 to about 300 as determined by ASTM D2270, and a Noack volatility of no greater than 25 percent as determined by ASTM D5800.

6. The lubricating oil of clauses 1-5 wherein the kinematic viscosity ($Kv_{100}$) of the base oil mixture as determined by ASTM D445 is reduced by greater than about 0.5 cSt.

7. The lubricating oil of clauses 1-6 which is a SAE 5W-20 engine oil, a SAE 5W-30 engine oil, or a SAE 10W-30 engine oil.

8. A method for improving fuel efficiency and energy efficiency, while maintaining or improving deposit control and cleanliness performance, in an engine lubricated with a lubricating oil by using as the lubricating oil a formulated oil, said formulated oil comprising a base oil mixture, wherein the base oil mixture comprises a lubricating oil base stock as a major component; and at least one cobase stock as a minor component at from 1 to 15 wt. % of the lubricating oil having a kinematic viscosity ($Kv_{100}$) of less than about 6.2 cSt at 100° C., to reduce kinematic viscosity ($Kv_{100}$) of the base oil mixture as determined by ASTM D445, while maintaining or controlling cold cranking simulator viscosity (CCSV) of the lubricating oil as determined by ASTM D5293-15, such that the lubricating oil meets both kinematic viscosity ($Kv_{100}$) and cold cranking simulator viscosity (CCSV) requirements for a SAE engine oil grade as determined by SAE J300 viscosity grade classification system; and wherein fuel efficiency and energy efficiency are improved and deposit control and cleanliness performance are maintained or improved as compared to fuel efficiency, energy efficiency, deposit control and cleanliness performance achieved using a lubricating oil containing a minor component other than the cobase stock, the lubricating oils having comparable cold cranking simulator viscosities (CCSVs) as determined by ASTM D5293-15 and high temperature high shear (HTHS) viscosities as determined by ASTM D4683-13.

9. The method of clause 8 wherein the at least one cobase stock is a $C_{20-36}$ polyalphaolefin, a $C_{24-32}$ polyalphaolefin, a $C_{24-28}$ polyalphaolefin, or mixtures thereof, and having from about 1 to about 4 branch points.

10. The method of clauses 8 and 9 wherein the at least one cobase stock is a dimerized, hydrogenated $C_{14}$ linear alphaolefin having a kinematic viscosity ($Kv_{100}$) less than about 4 cSt at 100° C. as determined by ASTM D445.

11. The method of clauses 8-10 wherein the lubricating oil has a kinematic viscosity ($Kv_{100}$) from about 2 cSt to about 12 cSt at 100° C. as determined by ASTM D445, a cold cranking simulator viscosity (CCSV) at −35° C. from about 1000 cP to about 6200 cP as determined by ASTM D5293-15, a cold cranking simulator viscosity (CCSV) at −30° C. from about 1000 cP to about 6600 cP as determined by ASTM D5293-15, a cold cranking simulator viscosity (CCSV) at −25° C. from about 1000 cP to about 7000 cP as determined by ASTM D5293-15, and a high temperature high shear (HTHS) viscosity of less than about 3.5 cP as determined by ASTM D4683-13.

12. The method of clauses 8-11 wherein the lubricating oil has a viscosity index (VI) from about 80 to about 300 as determined by ASTM D2270, and a Noack volatility of no greater than 25 percent as determined by ASTM D5800.

13. The method of clauses 8-12 wherein the kinematic viscosity ($Kv_{100}$) of the base oil mixture as determined by ASTM D445 is reduced by greater than about 0.5 cSt.

14. The method of clauses 8-13 wherein the lubricating oil is a SAE 5W-20 engine oil, a SAE 5W-30 engine oil, or a SAE 10W-30 engine oil.

15. The method of clauses 8-14 wherein the lubricating oil base stock comprises a Group III base stock, a Group IV base stock, or mixtures thereof.

All patents and patent applications, test procedures (such as ASTM methods, UL methods, and the like), and other documents cited herein are fully incorporated by reference to the extent such disclosure is not inconsistent with this disclosure and for all jurisdictions in which such incorporation is permitted.

As used herein, SAE J300 viscosity grade classification system refers to the SAE J300 2015 Edition, January 2015, published by SAE International.

When numerical lower limits and numerical upper limits are listed herein, ranges from any lower limit to any upper limit are contemplated. While the illustrative embodiments of the disclosure have been described with particularity, it will be understood that various other modifications will be apparent to and can be readily made by those skilled in the art without departing from the spirit and scope of the disclosure. Accordingly, it is not intended that the scope of the claims appended hereto be limited to the examples and descriptions set forth herein but rather that the claims be construed as encompassing all the features of patentable novelty which reside in the present disclosure, including all features which would be treated as equivalents thereof by those skilled in the art to which the disclosure pertains.

The present disclosure has been described above with reference to numerous embodiments and specific examples. Many variations will suggest themselves to those skilled in this art in light of the above detailed description. All such obvious variations are within the full intended scope of the appended claims.

The invention claimed is:

1. A lubricating oil comprising a base oil mixture, wherein the base oil mixture comprises a lubricating oil base stock as a major component wherein the lubricating oil base stock comprises a Group III base stock, a Group IV base stock, or mixtures thereof; and at least one cobase stock as a minor component present in the lubricating oil at from 1 to 12 wt.%, based on the total weight of the lubricating oil, and having a kinematic viscosity ($Kv_{100}$) of less than about 6.2 cSt at 100° C., wherein the cobase stock is an mPAO dimer produced by dimerization of an alpha-olefin using a metallocene catalyst, wherein the cobase stock is_selected from the group consisting essentially of $C_{28}$ methyl paraffin produced from a C14 linear alpha-olefin dimer, and wherein the cobase stock reduces the kinematic viscosity ($Kv_{100}$) of the base oil mixture as determined by ASTM D445, while maintaining or controlling cold cranking simulator viscosity (CCSV) of the lubricating oil as determined by ASTM D5293-15, such that the lubricating oil meets both kinematic viscosity ($Kv_{100}$) and cold cranking simulator viscosity (CCSV) requirements for a SAE engine oil grade as determined by SAE J300 viscosity grade classification system, and wherein the CCS at −35° C. of the cobase stock is greater than or equal to 2,000,000 cP.

2. The lubricating oil of claim 1 which is a SAE 5W-20 engine oil, a SAE 5W-30 engine oil, or a SAE 10W-30 engine oil.

3. The lubricating oil of claim 1 in which the kinematic viscosity ($Kv_{100}$) of the base oil mixture as determined by ASTM D445 is reduced, as compared to kinematic viscosity ($Kv_{100}$) of a base oil mixture containing a minor component other than the cobase stock, the lubricating oils having comparable cold cranking simulator viscosities (CCSVs) as determined by ASTM D5293-15 and high temperature high shear (HTHS) viscosities as determined by ASTM D4683-13.

4. The lubricating oil of claim 3 wherein the kinematic viscosity ($Kv_{100}$) of the base oil mixture as determined by ASTM D445 is reduced by greater than about 0.5 cSt.

5. The lubricating oil of claim 1 in which Noack volatility of the lubricating oil as determined by ASTM D5800 is reduced, as compared to Noack volatility of a lubricating oil containing a minor component other than the cobase stock, the lubricating oils having comparable cold cranking simulator viscosities (CCSVs) as determined by ASTM D5293-15 and high temperature high shear (HTHS) viscosities as determined by ASTM D4683-13.

6. The lubricating oil of claim 5 wherein the Noack volatility of the lubricating oil as determined by ASTM D5800 is reduced by about 0.5 to about 2.5 weight percent.

7. The lubricating oil of claim 1 which has a kinematic viscosity ($Kv_{100}$) from about 2 cSt to about 12 cSt at 100° C. as determined by ASTM D445, a cold cranking simulator viscosity (CCSV) at −35° C. from about 1000 cP to about 6200 cP as determined by ASTM D5293-15, a cold cranking simulator viscosity (CCSV) at −30° C. from about 1000 cP to about 6600 cP as determined by ASTM D5293-15, a cold cranking simulator viscosity (CCSV) at −25° C. from about 1000 cP to about 7000 cP as determined by ASTM D5293-15, and a high temperature high shear (HTHS) viscosity of less than about 3.5 cP as determined by ASTM D4683-13.

8. The lubricating oil of claim 1 having a viscosity index (VI) from about 80 to about 300 as determined by ASTM D2270, and a Noack volatility of no greater than 25 percent as determined by ASTM D5800.

9. The lubricating oil of claim 1 which has a MTM traction reduction of greater than about 5% as compared to MTM traction of a lubricating oil containing a minor component other than the cobase stock, as determined by the MTM (Mini Traction Machine) traction test.

10. The lubricating oil of claim 1 which further comprises one or more of a viscosity improver, antioxidant, detergent, dispersant, pour point depressant, corrosion inhibitor, metal deactivator, seal compatibility additive, anti-foam agent, inhibitor, and anti-rust additive.

11. The lubricating oil of claim 1 wherein the lubricating oil base stock is present in an amount from about 88 weight percent to about 98 weight percent, based on the total weight of the lubricating oil.

12. The lubricating oil of claim 1 which is a passenger vehicle engine oil (PVEO) or a commercial vehicle engine oil (CVEO).

13. The lubricating oil of claim 1 wherein the at least one cobase stock is a linear monoester having a kinematic viscosity (Kv100) less than about 6 cSt at 100° C. as determined by ASTM D445.

14. The lubricating oil of claim 1 wherein the at least one cobase stock further comprises coconut oil, decyl palmitate, and/or C18 dimer.

15. The lubricating oil of claim 14 wherein the coconut oil is hydrogenated to reduce the level of unsaturated acid components.

16. A method for improving fuel efficiency and energy efficiency, while maintaining or improving deposit control and cleanliness performance, in an engine lubricated with a lubricating oil by using as the lubricating oil a formulated oil, said formulated oil comprising a base oil mixture, wherein the base oil mixture comprises a lubricating oil base stock as a major component and wherein the lubricating oil base stock comprises a Group III base stock, a Group IV base stock, or mixtures thereof; and at least one cobase stock as a minor component present in the lubricating oil at from 1 to 12 wt. % based on the total weight of the lubricating oil and having a kinematic viscosity ($Kv_{100}$) of less than about 6.2 cSt at 100° C., wherein the at least one cobase stock is an mPAO dimer produced by dimerization of an alpha-olefin using a metallocene catalyst, wherein the cobase stock is selected from a group consisting essentially of C28 methyl paraffin produced from a C14 linear alpha-olefin dimer, decyl palmitate, coconut oil and C18, wherein the cobase stock reduces kinematic viscosity ($Kv_{100}$) of the base oil mixture as determined by ASTM D445, while maintaining or controlling cold cranking simulator viscosity (CCSV) of the lubricating oil as determined by ASTM D5293-15, such that the lubricating oil meets both kinematic viscosity ($Kv_{100}$) and cold cranking simulator viscosity (CCSV) requirements for a SAE engine oil grade as determined by SAE J300 viscosity grade classification system; and wherein fuel efficiency and energy efficiency are improved and deposit control and cleanliness performance are maintained or improved as compared to fuel efficiency, energy efficiency, deposit control and cleanliness performance achieved using a lubricating oil containing a minor component other than the cobase stock, the lubricating oils having comparable cold cranking simulator viscosities (CCSVs) as determined by ASTM D5293-15 and high temperature high shear (HTHS) viscosities as determined by ASTM D4683-13, and wherein the CCS at −35° C of the cobase stock is greater than or equal to 2,000,000 cP; and wherein the lubricating oil is a SAE 5W-20 engine oil, a SAE 5W-30 engine oil, or a SEA 10W-30 engine oil.

17. The method of claim 16 in which kinematic viscosity ($Kv_{100}$) of the base oil mixture as determined by ASTM D445 is reduced, as compared to kinematic viscosity ($Kv_{100}$) of a base oil mixture containing a minor component other than the cobase stock, the lubricating oils having comparable cold cranking simulator viscosities (CCSVs) as determined by ASTM D5293-15 and high temperature high shear (HTHS) viscosities as determined by ASTM D4683-13.

18. The method of claim 17 wherein the kinematic viscosity ($Kv_{100}$) of the base oil mixture as determined by ASTM D445 is reduced by greater than about 0.5 cSt.

19. The method of claim 16 in which Noack volatility of the lubricating oil as determined by ASTM D5800 is reduced, as compared to Noack volatility of a lubricating oil containing a minor component other than the cobase stock, the lubricating oils having comparable cold cranking simulator viscosities (CCSVs) as determined by ASTM D5293-15 and high temperature high shear (HTHS) viscosities as determined by ASTM D4683-13.

20. The method of claim 19 wherein the Noack volatility of the lubricating oil as determined by ASTM D5800 is reduced by about 0.5 to about 2.5 weight percent.

21. The method of claim 16 wherein the lubricating oil has a kinematic viscosity ($Kv_{100}$) from about 2 cSt to about 12 cSt at 100° C. as determined by ASTM D445, a cold cranking simulator viscosity (CCSV) at −35° C. from about 1000 cP to about 6200 cP as determined by ASTM D5293-15, a cold cranking simulator viscosity (CCSV) at −30° C. from about 1000 cP to about 6600 cP as determined by ASTM D5293-15, a cold cranking simulator viscosity (CCSV) at −25° C. from about 1000 cP to about 7000 cP as determined by ASTM D5293-15, and a high temperature high shear (HTHS) viscosity of less than about 3.5 cP as determined by ASTM D4683 13.

22. The method of claim 16 wherein the lubricating oil has a viscosity index (VI) from about 80 to about 300 as determined by ASTM D2270, and a Noack volatility of no greater than 25 percent as determined by ASTM D5800.

23. The method of claim 16 wherein the lubricating oil has a MTM traction reduction of greater than about 5% as compared to MTM traction of a lubricating oil containing a minor component other than the cobase stock, as determined by the MTM (Mini Traction Machine) traction test.

24. The method of claim 16 wherein the lubricating oil further comprises one or more of a viscosity improver, antioxidant, detergent, dispersant, pour point depressant, corrosion inhibitor, metal deactivator, seal compatibility additive, anti-foam agent, inhibitor, and anti-rust additive.

25. The method of claim 16 wherein the lubricating oil base stock is present in an amount from about 88 weight percent to about 98 weight percent, and the cobase stock is present in an amount from about 2 weight percent to about 12 weight percent, based on the total weight of the lubricating oil.

26. The method of claim 16 wherein the lubricating oil is a passenger vehicle engine oil (PVEO) or a commercial vehicle engine oil (CVEO).

27. The method of claim 16 wherein the at least one cobase stock is a linear monoester having a kinematic viscosity (Kv100) less than about 6 cSt at 100° C. as determined by ASTM D445.

* * * * *